US006224201B1

(12) United States Patent
Shigemura

(10) Patent No.: US 6,224,201 B1
(45) **Date of Patent: *May 1, 2001**

(54) INK JET RECORDING APPARATUS PROVIDED WITH AN IMPROVED INK SUPPLY ROUTE

(75) Inventor: Yoshihiro Shigemura, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/121,060

(22) Filed: Jul. 23, 1998

(30) Foreign Application Priority Data

Jul. 28, 1997 (JP) ..... 9-201806
Jul. 28, 1997 (JP) ..... 9-201807

(51) Int. Cl.[7] ..... B41J 2/175
(52) U.S. Cl. ..... 347/93
(58) Field of Search ..... 347/85, 89, 93, 347/107, 92

(56) References Cited

U.S. PATENT DOCUMENTS 4,045,296 * 8/1977 Sternberg ..... 195/103.5
4,460,904 * 7/1984 Oszczakiewicz et al. ..... 364/75
4,502,055 * 2/1985 Horike et al. ..... 347/92
5,856,010 * 1/1999 Furuya et al. ..... 428/407
5,942,408 * 8/1999 Christensen et al. ..... 435/31

FOREIGN PATENT DOCUMENTS 57-83488 5/1982 (JP) .
59-075205 4/1984 (JP) .
62-288045 12/1987 (JP) .
63-145039 6/1988 (JP) .
63-235901 9/1988 (JP) .
63-294503 12/1988 (JP) .
1-217302 8/1989 (JP) .
5-17712 1/1993 (JP) .

* cited by examiner

*Primary Examiner*—N. Le
*Assistant Examiner*—Michael Nghiem
(74) *Attorney, Agent, or Firm*—Fitzpatrick, Cella, Harper & Scinto

(57) ABSTRACT

An ink jet recording apparatus for recording by discharging ink comprises an ink tank for retaining ink to be discharged, an ink jet head provided with a discharge port for discharging retained ink, an ink route connecting the ink tank with the ink jet head to form the ink flow from the ink tank to the ink jet head, a deaerator arranged on the way of the ink route to remove gas contained in ink. For this ink jet recording apparatus, at least the section in which the deaerator is connected with the ink jet head in the ink route is formed by material containing polyvinylidene fluoride resin. With the structure thus arranged, the sufficiently deaerated ink is supplied to the ink jet head for the stable discharges of ink without wasting ink, hence reliably forming precise images at lower costs.

31 Claims, 10 Drawing Sheets

INK JET RECORDING APPARATUS PROVIDED WITH AN IMPROVED INK SUPPLY ROUTE

BACKGROUND OF THE INVENTION

1. Field of the Invention

The present invention relates to an ink jet recording apparatus provided with an ink supply route having a deaerator therefor. The invention also relates to an apparatus for manufacturing color filters that manufactures color filters by coloring a transparent substrate with ink by use of such ink jet recording apparatus.

2. Related Background Art

The ink jet recording method has conventionally been adopted as output means of information processing systems, such as a printer serving as the output terminal of a copying machine, a facsimile equipment, an electronic typewriter, a word processor, or a work station or it has been adopted conventionally as the recording method of a handy or a portable printer provided for a personal computer, a host computer, an optical disc device, a video apparatus, or the like.

The ink jet recording method is used for recording characters, figures, and the like by discharging fine ink droplets from nozzles (hereinafter referred to as discharge ports). This method has excellent advantages in the output of highly precise images as recording means executable at higher speeds. Also, the recording apparatus to which the ink jet recording method is applicable (hereinafter referred to as an ink jet recording apparatus) is of non-impact type, and makes a lesser amount of noises when operated. Also, it is easier for the apparatus to use ink of many colors for recording color images. Further, among some other advantages, the apparatus main body can be made smaller and easier to provide highly densified images. With such wider use, the ink jet recording method has rapidly been in demand increasingly more in recent years.

Also, along with the development of personal computers, particularly the portable personal computers, there has been a tendency that the liquid crystal display, particularly its color display, is in demand more in recent years. However, in order to popularize the use of this type of display more widely, it is necessary to reduce its costs of manufacture. Particularly, the reduction of costs is demanded more on the color filters, because they cost high.

There have been attempted various methods in order to meet such demand on the cost reduction, while maintaining the required characteristics of color filters satisfactorily. However, no method has been established as yet to satisfy all the requirements in this aspect. Now, hereunder, the description will be made of some of the methods for manufacturing color filters; here, R, G, B stand for red, green, and blue in the description given below.

There is the dyeing method as a first method for manufacturing color filters. The dyeing method is such that on the glass substrate, water soluble polymer material is coated for use of dyeing, and that after patterning the water soluble polymer material to a desired configuration by means of photolithographic process, the pattern thus obtained is immersed into the dyeing bath. In this manner, the colored pattern is obtained. By repeating this process three times, the R, G, B color filter layers are produced on the glass substrate.

There is the pigments dispersion method as a second method for manufacturing color filters. The pigments dispersion method has almost taken place of the dyeing method in recent years. The pigments dispersion method is such that pigments are dispersed on the substrate to form a photosensitive resin layer, and that by patterning this photosensitive rain layer, a monochrome pattern is obtained. Then, by repeating this process three times, the R, G, B color filter layers are formed on the substrate.

There is the electrodeposition method as a third method for manufacturing color filters. The electrodeposition method is such that on the substrate, transparent electrodes are patterned, and then, the substrate is immersed in the electrodeposition coating agent that contains pigments, resin, and electrolytic solution, among some others, thus electrodepositing a desired color on the substrate. By repeating this process three times, R, G, B are separately coated on the substrate, and after that, resin is thermally hardened to form the surface color layer on the substrate.

There is the printing method as a fourth method for manufacturing color filters. The printing method is such that pigments are dispersed on the thermally hardening resin, and printing is repeated three times using such resin for the separate coating of R, G, B. After that, resin is thermally hardened to form color layers on the substrate. Also, it is generally practiced to form a protection layer on the surface of the color layer produced by any one of these methods described above.

The processing aspect that shared by these methods is the need for the three-time repetition of one and the same process for coloring in R, G, B, which inevitably results in the higher costs. Then, there is a problem that the more the processes are needed, the more production yield is reduced. Further, for the electrodeposition method, the formable pattern configuration is automatically limited. Therefore, the techniques currently in use for this method is not applicable to manufacturing the color liquid crystal display of the TFT type. Also, with the printing method, the resultant resolution and smoothness are not good enough to form patterns at fine pitches.

In order to compensate for these drawbacks, a method for manufacturing color filters with an ink jet recording method is proposed as disclosed in the specification of Japanese Patent Laid-Open Application No. 59-75205, Japanese Patent Laid-Open Application No. 63-235901, Japanese Patent Laid-Open Application No. 63-294503, or Japanese Patent Laid-Open Application No. 1-217302, among some others.

Of these methods disclosed in them, the method for manufacturing color filters by means of the ink jet recording method is typically such that a light shielding film is provided to form apertures on the transparent substrate with a specific regularity, and that ink is discharged from the ink jet head for coloring on the transparent substrate having such exposed apertures on it.

The material costs of the color filters produced by use of the ink jet recording method can be made lower, because coloring is given only on the parts that require it. Moreover, it is possible to provide the three colors at a time. The required time for manufacturing steps is shorter to make it easier to avoid influences that may be exerted by the presence of dust particles. Also, the costs of manufacturing system can be made lower. As a result, the lower material costs and the higher production yields can be anticipated for the reasons described above, among some others, and as compared with the other methods of manufacture, it is possible to manufacture color filters at lower costs by use of the ink jet recording method.

FIG. 11 is a view which schematically shows the structure of the ink supply system of the conventional ink jet recording apparatus. As shown in FIG. 11, the ink supply system of the conventional ink jet recording apparatus comprises an ink jet heat 1100; a sub-tank 1401 retaining ink to be supplied to the ink jet head 1100; and a main tank 1301 retaining ink to be supplied to the sub-tank 1401.

On the inner bottom surface of the main tank 1301, the one end of a tube 1351 is arranged, and the other end of the tube 1351 is connected with one end of a tube 1352 outside the main tank 1301 through a main pump 1302. On the portion of the tube 1351 near the main tank, one end of a tube 1355 is connected for use of the air communication through a joint 1371. The other end of the tube 1355 is connected with one end of a tube 1356 for use of the air communication through a two-way valve 1304. When the two-way valve is open, the air outside and the tube 1351 are communicated through the other end of the tube 1356 by way of the tubes 1356 and 1355. In FIG. 11, the two-way valve is in the state of being closed.

On the other hand, one end of a tube 1353 is connected with the other end of the tube 1352 through a reverse flow prevention valve 1303. To the other end of the tube 1353, one end of a tube 1453 and one end of a tube 1452 are connected through a joint 1471. The other end of the tube 1453 is connected with one end of a tube 1454 in the vicinity of the sub-tank 1401 through a two-way valve 1403, while the other end of the tube 1454 is communicated with the interior of the sub-tank 1401. The ink supply from the main tank 1301 to the sub-tank 1401 is made through the tubes 1351, 1352, 1353 and 1454. Then, by means of the two-way valve 1403, the ink supply route is closed or opened between the main tank 1301 and the sub-tank 1401.

For the sub-tank 1401, there are arranged a turbine 1402*a* that rotates on the bottom in the interior of the sub-tank 1401, and a motor 1402 that drives the turbine 1402*a*. Near the portion where the turbine 1402*a* is provided for the sub-tank 1401, one end of a tube 1451 is connected, and the other end of the tube 1451 is connected with an air buffer 1501. When the turbine 1402*a* is driven, ink in the sub-tank 1401 is compressed and carried to the air buffer 1501 through the tube 1451.

Also, from the side wall of the sub-tank 1401, an exhaust drain 1404, which is communicated with the interior of the sub-tank 1401, is extended, and one end of a tube 1354 is connected with the leading end of the exhaust drain 1404. The other end of the tube 1354 is led into the main tank 1301. With the exhaust drain 1404 arranged at a specific height from the bottom end of the sub-tank 1401, ink in the sub-tank 1401 is exhausted from the exhaust drain 1404 at a predetermined liquid level. Ink thus exhausted from the exhaust drain 1404 returns through the tube 1354 to the interior of the main tank 1301 from the other end of the tube 1354.

On the bottom end of the air buffer 1501, each end of tubes 1551 and 1553 is connected, respectively. The other end of the tube 1551 is connected with the ink supply route in the ink jet head 1100 through a connector 1102. On the other hand, the other end of the tube 1553 is connected with a three-way valve 1502. Then, one end of a tube 1552 and one end of a tube 1554 are connected with the three-way valve 1502. In FIG. 11, the tube 1553 and the tube 1552 are joined by means of this three-way valve 1502. The other end of the tube 1552 is connected with the ink supply route in the ink jet head 1100 through a connector 1102. This connector 1102 enables the ink jet head 1100 to be detachably connected with the ink supply system. When the ink jet head 1100 should be replaced with another one, the ink jet head 1100 can be removed from the ink supply system in this portion the connector 1102. On the ink jet head 1100, discharge ports 1100*a* are formed, and ink is supplied to these discharge ports 1100*a* from the ink supply route in the ink jet head 1100.

Also, to a position of the side wall of the air buffer 1501 at a predetermined height, one end of a tube 1555 is connected. The other end of the tube 1555 is connected with one end of the tube 1556 through a two-way valve 1503. The other end of the tube 1556 is connected with the other end of the tube 1554 and the other end of the tube 1452 described earlier by way of a joint 1571. In this manner, the ink supply route is structured so that even if vibration is given to the ink supply system due to the movement of the ink jet head 1100 in the scanning directions, such influence may be exerted on the ink supply system by the vibration is not allowed to reach the ink jet head 1100 side. Thus, the discharges of ink from the discharge ports 1100*a* are prevented from becoming instable so as to generate density unevenness or the like.

FIG. 12 is a partly enlarged view which shows the ink supply system represented in FIG. 11. Now, with reference to FIG. 12, the description will be made of the operation of the conventional ink supply system of an ink jet recording apparatus.

When the usual printing is performed, ink 1100*b* is discharged from the discharge ports 1100*a* of the ink jet head 1100 as flying liquid droplets as shown in FIG. 12. Then, negative pressure is exerted in the interior of the ink supply route of the ink jet head 1100. With this negative pressure of ink in the ink jet head 1100, ink in the sub-tank 1401 is supplied to the ink jet head 1100 through the tube 1451, the air buffer 1501, and the tube 1551. Also, a part of ink in the interior of the air buffer 1501 is branched into the tubes 1553 and 1552 and supplied to the ink jet head 1100. With ink thus supplied, ink jet head 1100 discharges ink from the discharge ports 1100*a* for recording on a recording medium. In this case, if bubbles are mixed in ink, the bubbles are trapped when passing the air buffer 1501 to let them reside on the upper part of the air buffer 1501. In this way, the bubbles in ink are removed so that the ink jet head 1100 may prevent its defective discharges from being caused by the presence of the bubbles.

Now, of the conventional ink jet recording apparatuses, the description will be made of the one which uses the deaerator.

As the method for stabilizing the ink discharges of an ink jet recording apparatus, there are known some methods whereby to remove the dissolved gas residing in ink to be supplied to the ink jet head. Of such methods, the one is disclosed in the specification of Japanese Patent Laid-Open Application No. 5-17712 for removing the dissolved gas residing in ink by allowing it to pass a film having a gas permeability. In accordance with such specification thus disclosed, the effect obtainable by deaerating ink in an ink jet recording apparatus that uses a piezoelectric elements is such that no cavitation occurs even if ink in the compression chamber is abruptly compressed repeatedly, and that no defective printing is caused to ensue by disabled ink discharges due to cavitation. As the ink deaerator, the film having the gas permeability is produced in the form of a tube, and at the same time that evacuation is effectuated outside such tube. Then, ink is allowed to pass the interior of the tube, In this manner, the dissolved gas in ink is removed to the outside of the tube, hence deaerating ink. As the use condition of such deaerator, the degree of vacuum is 1 atm (76 Torr) or less outside the tube. However, there is no particular reference made as to the level of the deaerated ink after having passed the deaerator.

Also, for the ink jet recording method that utilizes film boiling for discharging ink, it has been confirmed that ink deaeration is effective. As the confirmed effect on such deaeration, it is known that with the supply of deaerated ink to the ink jet head, the bubbles that may cause defective discharges can be prevented from being carried into the ink jet head.

For an ink jet recording apparatus capable of deaerating ink, there are known structures (such as disclosed in the specifications of Japanese Patent Laid-Open Application No. 57-83488 and Japanese Patent Laid-Open Application No. 62-288045) in which an ink tube is formed by flexible plastic material having an excellent ink resistance on the inner surface exposed to ink, which is arranged on the ink supply route from the ink tank to the ink jet head, and then, this tube is covered by a material whose air permeability is small. More specifically, it is conventionally regarded as the most suitable structure that a plastic material having softness is always used for an ink supply tube in order to make it possible for the ink jet head to move, and then, the polyethylene inner tube is externally covered by polyvinylidene chloride.

However, when an ink jet head is used for a color filter manufacturing apparatus, there is a need for the enhancement of its shooting accuracy almost by one digit higher than that of the printer generally in use, because unlike the case where the ink jet head is used for a usual printer, coloring should be made on the transparent substrate by discharging ink from the predetermined discharge ports which are arranged with strict regularity. Therefore, the color filter manufacturing apparatus is structured differently from the usual ink jet recording apparats. It is generally practiced for the usual ink jet recording apparatus to record images by discharging ink to a recording medium, while causing the ink jet head to scan forward and backward in the direction at right angles to the carrying direction of the recording medium. On the other hand, the ink jet head is fixed for the color filter manufacturing apparatus, because it is required for the ink jet head to secure highly precise positions for the performance of its discharges. Then, ink is discharged from the ink jet head, while the transparent substrate mounted on the stage being scanned in the X-Y directions underneath the fixed ink jet head.

Also, for the conventional ink jet recording apparatus, the air buffer is provided for the ink supply system thereof as shown in FIG. 11 and FIG. 12 which illustrate the conventional techniques. With the air buffer, it is made possible to eliminate any influence that may be exerted by the vibration generated by the movement of the ink jet head in the scanning directions. Then, it is attempted to stabilize the ink discharges, and at the same time, to prevent defective discharges of the ink jet head from being caused by the creation of bubbles in ink by trapping them for removal when ink passes the air buffer if any bubbles are mixed in ink.

However, as described earlier, for the color filter manufacturing apparatus that uses the ink jet head, the ink jet head is fixed and does not scan in order to obtain higher precision. Therefore, unlike the usual ink jet recording apparatus, there is no possibility that the vibration generated in the ink supply system due to the movement of the ink jet head in the scanning directions exerts any influence on ink discharges.

Also, for the conventional system, ink in the ink supply route is pressurized to circulate it in the ink supply route by means of the turbine or the like serving as ink supply means in order to keep the amount of air constantly in the air buffer or to perform the recovery operation for the ink jet head. The operation to pressurize ink at that time is such as to act upon the air residing on the upper part of the air buffer to be dissolved into ink pressured by ink supply means. Then, the ink into which the air is dissolved is supplied to the ink jet head. As a result, the air dissolved in ink is extracted in the tubes between the air buffer and the ink jet head after a specific time has elapsed. Therefore, ink may be supplied to the ink jet head, in some cases, together with the dissolved air which is in the state of being extracted from ink.

Also, when color filters are manufactured, ink currently used for the color filter manufacturing apparatus should be replaced with some other ink having different density or different color itself in order to change the colors of the color filter minutely. In this case, it is necessary for the conventional ink supply system of the color filter manufacturing apparatus to draw out ink current in use from the ink supply route completely. After that, new ink is filled in the ink supply system. When such new ink is filled in the system, the ink jet head 1100 should be removed from the connector 1102 shown in FIG. 11. Then, a bypass jig is mounted on the connector 1102, instead of the ink jet head 1100, in order to bypass the ink supply route for filling new ink. When new ink is filled, the bypass jig is removed from the connector 1102, and then, the ink jet head head 1100 is fixed to the connector 1102 again. Here, however, when the ink jet 1100 is again fixed, the air is always mixed in the interior of the connector 1102. The air once mixed is carried over into the interior of the ink jet head 1100 eventually, and in some cases, it may cause the disabled ink discharges or the defective ink discharges. Further, in order to exhaust the air mixed in the ink supply route immediately close to the ink jet head 1100, it is arranged to supply ink by the ink supply means so that the air is pushed out from the discharge ports 1100*a* of the ink jet head 1100. In this case, ink is forcibly pushed out from the discharge ports 1100*a*. Then, a problem is created that ink is wastefully consumed.

Now, for an ink jet recording apparatus capable of deaerating ink, there are known structures (such as disclosed in the specifications of Japanese Patent Laid-Open Application No. 57-83488 and Japanese Patent Laid-Open Application No. 62-288045) in which an ink tube is formed by flexible plastic material having an excellent ink resistance on the inner surface exposed to ink, which is arranged on the ink supply route from the ink tank to the ink jet head, and then, this tube is covered by a material whose air permeability is small. More specifically, it is regarded as the most suitable structure conventionally that a plastic material having softness always used for an ink supply tube in order to make it possible for the ink jet head to move, and then, the polyethylene inner tube is externally covered by polyvinylidene chloride.

However, when an ink jet head is used for a color filter manufacturing apparatus, there is a need for the enhancement of its shooting accuracy almost by ten times higher than that of the printer generally in use, because unlike the case where the ink jet head is used for a usual printer, coloring should be made on the transparent substrate by discharging ink from the predetermined discharge ports which are arranged with strict regularity. Therefore, the color filter manufacturing apparatus is structured differently from the usual ink jet recording apparats. It is generally practiced for the usual ink jet recording apparatus to record images by discharging ink to a recording medium, while causing the ink jet head to scan forward and backward in the direction at right angles to the carrying direction of the recording medium. On the other hand, the structure is adopted for the color filter manufacturing apparatus in which the ink jet head is fixed in order to meet the required precision, and then, ink is discharged from the ink jet head to the transparent substrate (recording medium) mounted on the stage that the head faces, while the substrate being scanned in the X-Y directions.

Since the extremely high precision is required for the color filters, it is easier for them to be defective as the finished product if the amount of discharged ink varies even slightly, because the difference in the amount of ink looks like streak unevenness on the transparent substrate when the ink jet recording method is used for the color filter manufacturing apparatus. Therefore, there is a need for the provision of much higher stability of the discharge amount than for the usual ink jet printer. In this respect, as a result of ardent studies as to the prevention of the unevenness that may be brought about by the fluctuation of the discharge amount, the inventor hereof has found that the deaerators incorporated on the way with the ink supply route of the ink jet head used for the color filter manufacturing apparatus may significantly contribute to reducing the generation of the aforesaid unevenness.

However, the color filter manufacturing apparatus is much larger than the usual ink jet printer, and also, the ink supply unit, such as ink tanks, should be structured outside the main body that includes the X-Y stage and the like. Therefore, the length of ink supply tubes that connect the ink tanks with the ink jet head becomes as long as several meters eventually. Also, for the color filter manufacturing apparatus, the ink jet heads are mounted on the apparatus to cover the three color portions of RGB, and each color ink jet head of those mounted on the apparatus should be provided with nozzles for use of ink discharges with the positional precision of in order of one $\mu$m or less. This requires highly precise positioning for each of them. Therefore, on the portion where ink jet heads are installed, the mechanism to adjust the position of each of the ink jet heads is arranged accordingly. In order to make the stability of ink discharges more effective by means of deaeration, it is desirable to arrange each of the deaerators immediately before each of the ink jet heads so that the deaerated ink should be supplied to the ink jet heads in the shortest possible distance without allowing the deaerated ink to run around in a considerable distance. However, for the reasons that the adjustment mechanism should be provided for each of the ink jet heads, and the arrangement of anything that has weight should preferably be avoided around such adjustment mechanism needed for securing higher precision, among some other reasons, it is impossible to arrange the deaerators by the side of each of the ink jet heads. Consequently, it is inevitable that the tubes become longer to supply ink from each of the deaerators to the ink jet head when the deaerators are incorporated with the apparatus.

Also, it is desirable to select the material of the tubes to supply ink to each of the ink jet head taking the gas permeability into consideration. In general, the gas permeability of tube is smaller when the thickness thereof is larger. As in the conventional case where resin such as polyethylene having excellent resistance to ink is used for the inner side of the tube, which is externally covered by polyvinylidene chloride, the gas permeability of such tube is determined almost by the thickness of polyvinylidene chloride. Therefore, if such tube is adopted for the ink supply route between each of the deaerator of the color filter manufacturing apparatus and the ink jet heads, the concentration of dissolved gas in ink tends to be increased, because the thinner polyvinylidene chloride together with the longer tube may admit the transmission of gas through the tube wall before the tube reaches each ink jet head, thus the gas that has transmitted the tube wall is dissolved into ink. Also, when ink jet heads are replaced, which necessitates the shifting of ink supply tubes, the resin cover whose gas permeability is smaller tends to be peeled off when the tubes are rubbed each other. Thus, there is a possibility that the tubes do not present sufficient resistance to the gas permeability eventually.

The inventor hereof has found that there is a need for supply deaerated ink to the head more effectively in order to carry out the production of color filters more stably, and also, means should be arranged so as not to lower the deaeration level of ink before ink reaches the ink jet heads from the respective deaerators.

SUMMARY OF THE INVENTION

On the basis of the knowledge thus obtained, the present invention is designed. It is an object of the invention to provide an ink jet recording apparatus capable of preventing the bubbles, which may invite disabled ink discharges or may result in the instability of ink discharges, from being carried over to the ink jet head in the ink supply system of a color filter manufacturing apparatus that uses the ink jet recording method, and also, to provide an ink jet recording apparatus which is capable of reliably supplying the ink deaerated to a constant level to the ink jet head to stabilize the amount of ink discharges. It is also an object of the invention to provide a color filter manufacturing apparatus that used such ink jet recording apparatus.

Also, in addition to the object described above, it is an object of the invention to arrange means so that when ink is replaced with different ink for the ink jet recording apparatus and the color filter manufacturing apparatus using the ink jet recording method, no air should be mixed in the ink supply route of the ink supply system, and that the ink supply route is filled with the ink deaerated to a constant level in a shorter period of time without consuming ink wastefully. Here, it is another object of the invention to prevent ink from being consumed wastefully when exhausting the air outside the ink supply route if the air is mixed in ink, and further, to reduce the frequency of maintenance required for the ink supply system in order to keep a color filter manufacturing apparatus in highly productive condition.

Now, in consideration of those problems described above, it is an object of the invention to stabilize the discharges of an ink jet head, as well as to produce color filters in good production yield by supplying sufficiently deaerated ink reliably to the head in the ink supply system of the image formation apparatus using the ink jet method.

In order to achieve the object described above, the ink jet recording apparatus of the present invention for recording by discharging ink in accordance with one embodiment comprises the following:

- an ink tank retaining ink to be discharged;
- an ink jet head provided with discharge ports for discharging retained ink;
- an ink route connecting the ink tank with the ink jet head to form the ink flow from the ink tank to the ink jet head;
- a deaerator arranged on the way of the ink route to remove gas contained in ink, at least the section connecting the deaerator in the ink route and the ink jet head being formed by material containing polyvinylidene fluoride.

It is preferable to structure the ink jet further comprising:

a second ink route connecting the ink jet head with the ink tank, and the deaerated ink passing the ink jet head being returned to the ink tank through the second ink route.

It may be possible to structure the ink jet apparatus further comprising a second ink tank, and a second ink route connecting the ink jet head with the second ink tank, the deaerated ink passing the ink jet head being returned to the second ink tank through the second ink route.

It is preferable to arrange a deaeration level measurement device for measuring the deaeration level in the section connecting the deaerator with the ink jet head.

Here, a dissolved oxygen meter is usable for the deaeration level measurement device.

In order to achieve the object described above, the ink jet recording apparatus of the present invention for recording by discharging ink in accordance another embodiment comprises the following:

an ink tank retaining ink to be discharged;

an ink jet head provided with discharge ports for discharging retained ink;

an ink route connecting the ink tank with the ink jet head to form the ink flow from the ink tank to the ink jet head;

a deaerator arranged on the way of the ink route to remove gas contained in ink; and a deaeration level measurement device arranged between the deaerator and the ink jet head.

It is preferable to form the section connecting the deaerator and the ink jet head in the ink route by material containing polyvinylidene fluoride.

It is possible to adopt the deaeration level measurement device structured with the provision of measuring means in a container having resistance to gas permeability with a connecting portion on the upper part thereof on the side of ink route connected with the ink jet head and a connecting portion on the lower part thereof on the side of ink route connected with the deaerator.

For the measurement means, a dissolved oxygen meter is usable.

The dissolved oxygen meter thus used is of polraro type.

It is preferable to arrange the structure so that the dissolved oxygen meter is in the form of rod and installed on the side of the container almost horizontally.

In order to achieve the object described above, the ink jet recording apparatus of the present invention for recording by discharging ink in accordance with still another embodiment comprises:

first and second ink tanks retaining ink to be discharged;

a plurality of ink jet heads provided with discharge ports for discharging retained ink;

a first ink route connecting the first ink tank with one end of the ink jet head;

a second ink route connecting the second ink tank with the other end of the ink jet head;

a third ink route being connected with a first connecting portion on the way of the first ink route, at the same time, being connected with a second connection portion on the way of the second ink route; and first and second switching means for changing ink flow paths provided for the first connection portion and the second connection portion, respectively.

It is possible to adopt three-way valves for the first and second switching means.

It is preferable to arrange a deaerator in the first ink route.

It is preferable to arrange the deaerator in the first ink route between the first ink tank and the first connecting portion.

It is preferably suitable to arrange a deaeration level measurement device between the deaerator and the first connecting portion for measuring the deaeration level of ink flowing in the ink route.

A dissolved oxygen meter is adoptable for the deaeration level measurement device.

It is preferable to provide control means for controlling the ink supply and suspension thereof in accordance with the deaeration level measured by the deaeration level measurement device.

Here, the control means controls the switching operation of the first and second switching means in accordance with the deaeration level measured by the deaeration level measurement device.

It is preferable to structure the first and second ink supply routes with tubes formed by material containing polyvinylidene fluoride.

It is preferable to structure at least the connecting path portion between the deaerator and the ink jet head by tubes formed by material containing polyvinylidene fluoride.

In order to achieve the object described above, the ink jet recording apparatus of the present invention for recording by discharging ink in accordance with a further embodiment comprises:

an ink tank retaining ink to be discharged;

a plurality of ink jet heads provided with discharge ports for discharging retained ink;

a first ink route connecting the first ink tank with one end of the ink jet head;

a second ink route connecting the second ink tank with the other end of the ink jet head;

a third ink route being connected with a first connecting portion on the way of the first ink route, at the same time, being connected with a second connection portion on the way of the second ink route; and first and second switching means for changing ink flow paths provided for the first connection portion and the second connection portion, respectively.

It is possible to adopt three-way valves for the first and second switching means.

It is preferable to arrange a deaerator in the first ink route.

It is preferable to arrange the deaerator in the first ink route between the first ink tank and the first connecting portion.

It is preferably suitable to arrange a deaeration level measurement device between the deaerator and the first connecting portion for measuring the deaeration level of ink flowing in the ink route.

A dissolved oxygen meter is adoptable for the deaeration level measurement device.

It is preferable to provide control means for controlling the ink supply and suspension thereof in accordance with the deaeration level measured by the deaeration level measurement device.

Here, the control means controls the switching operation of the first and second switching means in accordance with the deaeration level measured by the deaeration level measurement device.

It is preferable to structure the first and second ink supply routes with tubes formed by material containing polyvinylidene fluoride.

It is preferable to structure at least the connecting path portion between the deaerator and the ink jet head by tubes formed by material containing polyvinylidene fluoride.

In order to achieve the object described above, the color filter manufacturing apparatus in accordance with still further embodiment of the present invention comprises:

the ink jet recording apparatus comprising an ink tank for retaining ink to be discharged; an ink jet head provided with a discharge ports for discharging retained ink; an ink route connecting said ink tank with said ink jet head to form the ink flow from said ink tank to said ink jet head; a deaerator arranged on the way of said ink route to remove gas contained in ink, at least the section connecting said deaerator and said ink jet head in said ink route being formed by material containing polyvinylidene fluoride resin; and a substrate for use of the color filter formation, the ink jet head of the ink jet recording apparatus and the substrate for the color filter formation being shifted relatively, and color filters being manufactured by discharging ink from the ink.

Also, the color filter manufacturing apparatus in accordance with another embodiment of the present invention comprises:

the ink jet recording apparatus comprising the deaeration level measurement device is a dissolved oxygen meter; and a substrate for use of the color filter formation, the ink jet head of the ink jet recording apparatus and the substrate for the color filter formation being shifted relatively, and color filters being manufactured by discharging ink from the ink.

Also, the color filter manufacturing apparatus in accordance with another embodiment of the present invention comprises:

the ink jet recording apparatus comprising first and second ink tanks for retaining ink to be discharged; an ink jet head provided with a plurality of discharge ports for discharging retained ink; a first ink route connecting said first ink tank with one end of said ink jet head; a second ink route connecting said second ink tank with the other end of said ink jet head; a third ink route being connected with a first connecting portion on the way of said first ink route and being connected with a second connection portion on the way of said second ink route; first and second switching means for changing ink flow paths provided for said first connection portion and said second connection portion, respectively; and a substrate for use of the color filter formation, the ink jet head of the ink jet recording apparatus and the substrate for the color filter formation being shifted relatively, and color filters being manufactured by discharging ink from the ink.

Also, the color filter manufacturing apparatus in accordance with another embodiment of the present invention comprises:

the ink jet recording apparatus comprising an ink tank for retaining ink to be discharged; an ink jet heads provided with a plurality of discharge ports for discharging retained ink; a first ink route connecting said first ink tank with one end of said ink jet head; a second ink route connecting said second ink tank with the other end of said ink jet head; a third ink route being connected with a first connecting portion on the way of said first ink route and being connected with a second connection portion on the way of said second ink route; first and second switching means for changing ink flow paths provided for said first connection portion and said second connection portion, respectively; and a substrate for use of the color filter formation, the ink jet head of the ink jet recording apparatus and the substrate for the color filter formation being shifted relatively, and color filters being manufactured by discharging ink from the ink.

DETAILED DESCRIPTION OF THE PREFERRED EMBODIMENTS

Hereinafter, with reference to the accompanying drawings, the description will be made of the embodiments in accordance with the present invention.

First Embodiment

The Entire Structure of A Color Filter Manufacturing Apparatus

Figure 1:
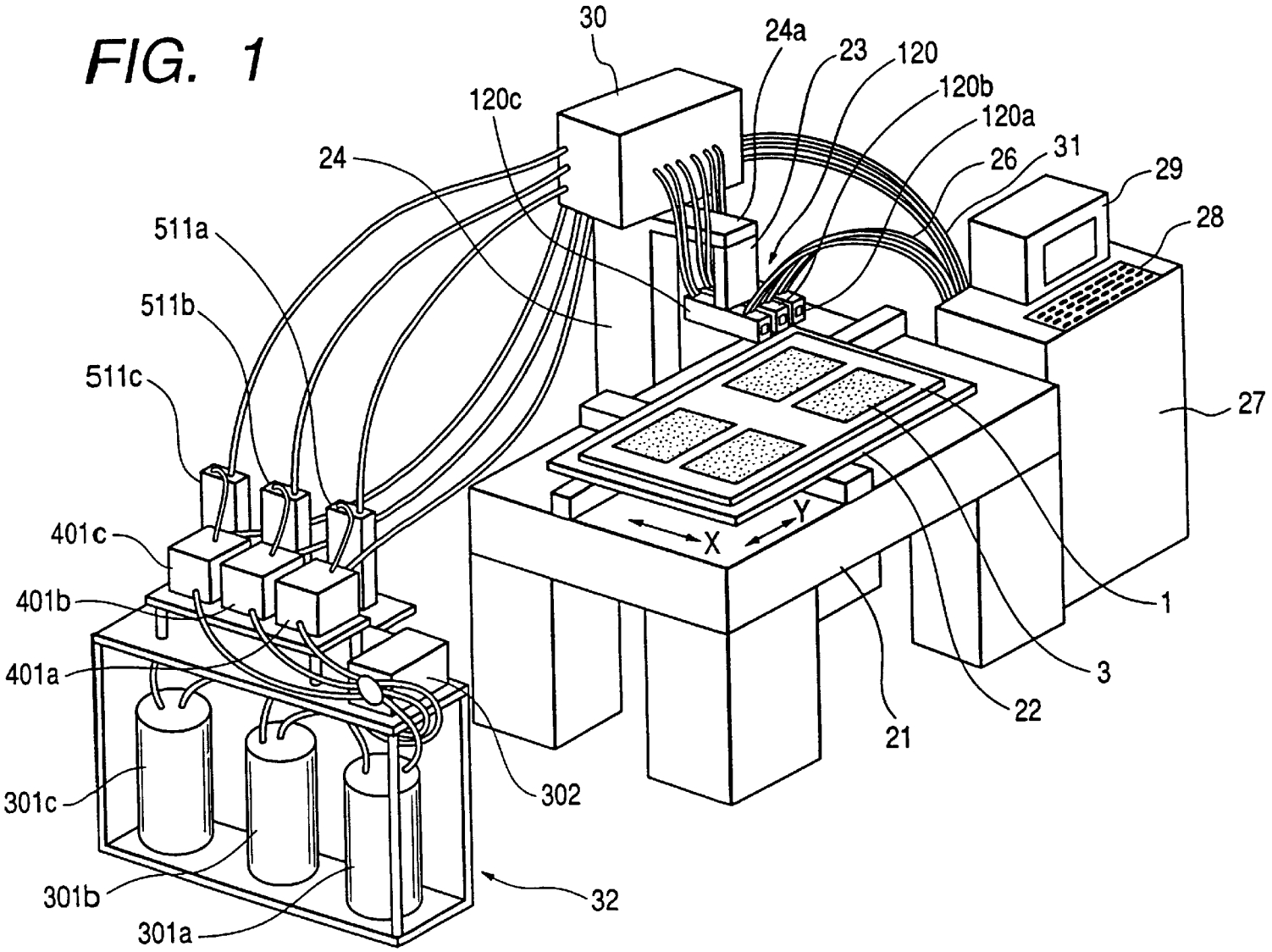
FIG. 1 is a perspective view which shows a color filter manufacturing apparatus in accordance with a first embodiment of the present invention.

FIG. 1 is a perspective view which shows a color filter manufacturing apparatus in accordance with a first embodiment of the present invention. As shown in FIG. 1, the color filter manufacturing apparatus of the present embodiment is provided with an X-Y table 22 movable in the directions X and Y on the upper surface of a base stand 21. On the side portion of the base stand 21, a supporting pole 24 is installed, and from the upper end of the supporting pole 24, a mounting member 24*a* is extended above the X-Y table 22 in the parallel direction. On the leading end of the mounting member 24*a,* ink jet heads 120 are fixed through a supporting member 23.

For the ink jet heads 120, each mounted position is adjustable with respect to the supporting member 23. The ink jet heads 120 are fixed to the supporting member 23 in the desired positions, respectively. In this manner, the ink jet heads 120 are fixed each on the desired position above the X-Y table 22 by means of the supporting pole 24 and the supporting member 23. Also, for the ink jet heads 120, it is arranged to provide an ink jet head 120*a* that discharges red ink; an ink jet head 120*b* that discharges green ink; and an ink jet head 120*c* that discharges blue ink. Meanwhile, on the upper surface of the X-Y table 22, a substrate 1 is mounted. On the surface of the substrate 1, the black matrix and resin component layer 3 are formed, which will be described later in conjunction with FIGS. 6A to 6F.

On the upper end of the supporting pole 24, a valve box 30 is installed. In the valve box 30, three-way valves, dissolved oxygen meters, and others are arranged with respect to each of the ink jet heads 120*a,* 120*b,* and 120*c*. The valve box 30 is connected with each of the ink jet heads 120*a,* 120*b,* and 120*c* by means of ink supply tubes, respectively. Also, for this color filter manufacturing apparatus, an ink supply unit 32 is provided to supply ink to each of the ink jet heads 120*a,* 120*b,* and 120*c* through each of the three-way valves in the valve box 30.

The ink supply unit 32 is provided with main tanks 301*a,* 301*b,* and 301*c;* a main pump 302; sub-tanks 401*a,* 401*b,* and 401*c;* and main deaerators 511*a,* 511*b,* and 511*c*. For the ink jet head 120*a,* the main tank 301*a,* sub-tank 401*a,* and main deaerator 511*a* are arranged correspondingly. For the ink jet head 120*b,* the main tank 301*b,* sub-tank 401*b,* and main deaerator 511*b* are arranged correspondingly. For the ink jet head 120*c,* the main tank 301*c,* sub-tank 401*c,* and main deaerator 511*c* are arranged correspondingly. Each of the sub-tanks 401*a,* 401*b,* and 401*c* and each of the main deaerators 111*a,* 511*b,* and 511*c* are connected with the valve box 30 through the respective tubes. In this way, ink is supplied from the ink supply unit 32 to each of the ink jet heads 120*a,* 120*b,* and 120*c*. Therefore, the ink supply system for this color filter manufacturing apparatus is formed by the ink supply unit 32, the valve box 30, and the tubes that constitute the respective ink supply routes from the ink supply unit 32 to the ink jet heads 120.

Also, from the valve box 30, a cable 31 is extended. To the leading end of the cable 31, a control box 27 is connected to serve as control means structured by a personal computer and the related devices. The cable 31 is prepared by bundling the cable used for driving three-way valves in the valve box 30 and the one extended from the dissolved oxygen meter together. Further, the control box 27 is connected with the ink jet heads 120*a,* 120*b,* and 120*c* by cables 26, respectively. On the control box 27, a keyboard 28 and a display unit 29 are installed.

The Structure of the Ink Supply System

Figure 2:
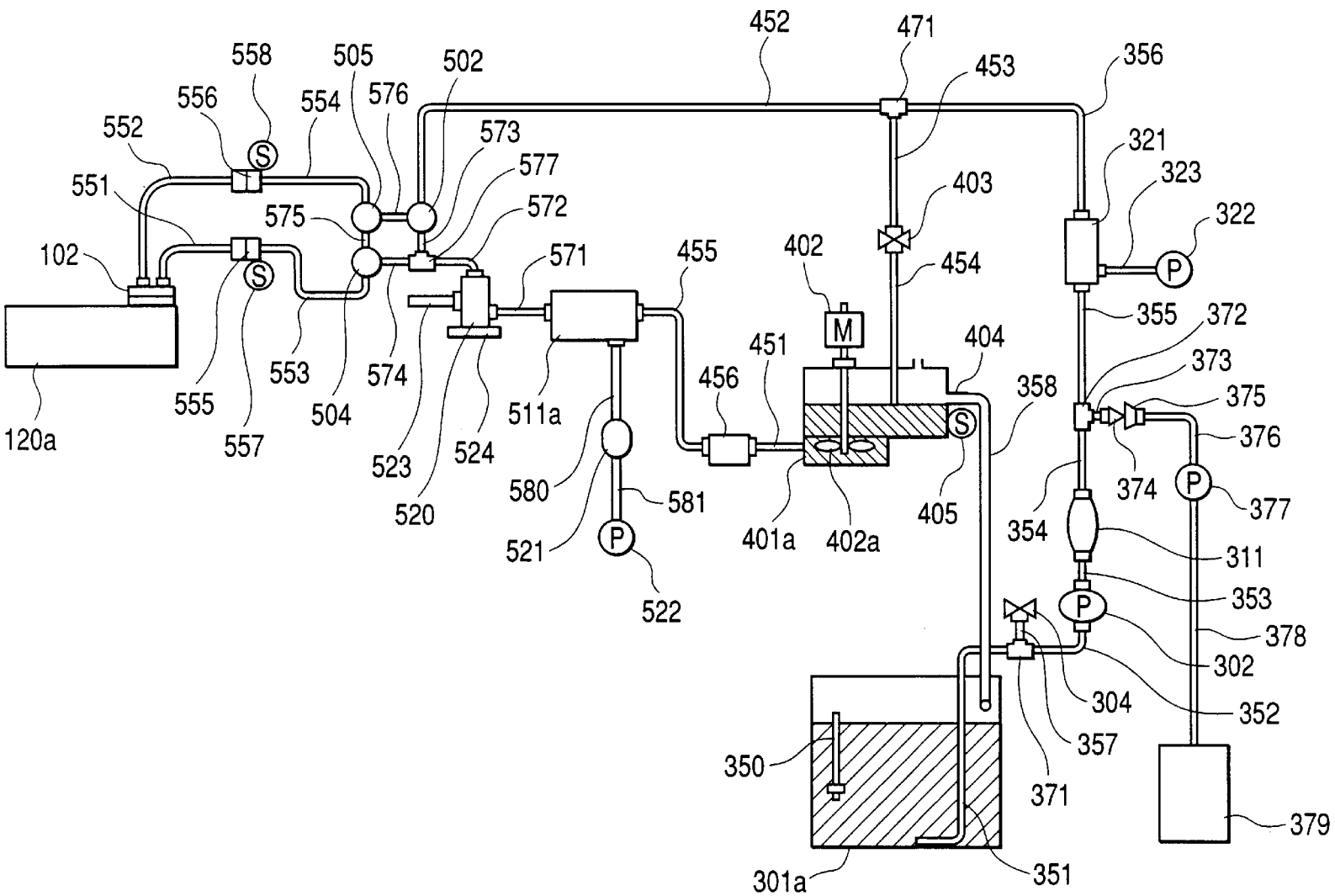
FIG. 2 is a view which schematically shows the structure of the ink supply system of the color filter manufacturing apparatus represented in FIG. 1.

FIG. 2 is a view which schematically shows the structure of the ink supply system of the color filter manufacturing apparatus represented in FIG. 1. Of the entire system of the ink supply shown in FIG. 1, FIG. 2 shows the system through which ink is supplied to the ink jet head 120*a*. The ink supply systems provided for the ink jet heads 120*b* and 120*c* are the same as the one shown in FIG. 2.

For the ink supply system of the color filter manufacturing apparatus of the present embodiment, there are provided, as shown in FIG. 2, a sub-tank 401*a* for retaining ink to be supplied to the ink jet head 120*a* and a main tank 301*a* for retaining ink to be supplied to the sub-tank 401*a*. With the sub-tank 401*a,* the water level is determined for ink to be discharged by the ink jet head 120*a*. In the interior of the main tank 301*a,* an ink remainders sensor 350 is arranged to detect the remainders of ink in the main tank 301*a*.

On the inner bottom surface of the main tank 301*a,* one end of a tube 351 is arranged, while the other end of the tube 351 is connected with the one end of a tube 352 by means of a joint 371. To the joint 371, one end of an air communicating tube 357 is connected, while the other end of the tube 357 is connected with a two-way valve 304. By means of the two-way valve 304, the end of the tube 357 is opened or closed. To the other end of the tube 352, the main pump 302 is connected. As the main pump 302, a tube pump is adopted to feed out ink by squeezing the tube in the progressing direction of ink. One end of a tube 353 is connected with the main pump 302, while the other end of the tube 353 is connected with one end of a tube 354 through a filter 311 having a grain capture diameter of 2 $\mu$m. To the other end of the tube 354, one end of a tube 355 is connected through a joint 372. To the joint 372, a coupler plug 374 is installed through a tube 373. To the other end of the tube 355, a deaerator 321 is connected for subservient use, and then, to the deaerator 321, a vacuum pump 322 is connected through a tube 323.

In the interior of the deaerator 321, a bundle of several gas permeable hollow pieces is arranged. When ink passes the hollow pieces thus bundled in the deaerator 321, the dissolved gas in ink is removed by the evacuating suction given by the vacuum pump 322 from the outside of the hollow pieces. As the hollow deaeration film that forms the hollow pieces, poly(4-methylpentene-1) is used. For the deaerator 321, ink is deaerated with the vacuum of 32±2 Torr provided by the vacuum pump 322 when ink passes the deaerator 321.

Further one end of a tube 356 is connected with the deaerator 321, while the other end of the tube 356 is connected with one end of a tube 452, as well as with one end of a tube 453 by means of a joint 471. To the other end of the tube 453, one end of a tube 454 is connected through a two-way valve 403. The other end of the tube 454 is communicated with the interior of the sub-tank 401*a*. Therefore, the ink supply from the main tank 301*a* to the sub-tank 401*a* is carried out by way of the tubes 351, 352, 353, 354, 355, 356, 453, and 454. Then, the intertank supply path is formed by the ink route between the tube 351 and the tube 356 through the main pump 302, filter 311, and the deaerator 321.

To the coupler plug 374 described earlier, it is possible to connect the coupler socket 375, but FIG. 2 shows a state where the coupler socket 375 is removed from the coupler plug 374. The coupler plug 374 has a mechanism that its leading end is closed if no connection is made to the coupler plug 374. On the other hand, one end of a tube 376 is connected with the coupler socket 375, while the other end of the tube 376 is connected with a suction pump 377. To the suction pump 377, a waste liquid tank 379 is connected through a tube 378. The ink suction system is formed by the coupler socket 375, the tube 376, the suction pump 377, the tube 378, and a waste liquid tank 379. The ink suction system is connected with the coupler plug 374 when ink is drained from the interior of the ink supply route.

On the bottom of the sub-tank 401*a,* one end of a tube 451 is connected, while the other end of the tube 451 is connected with one end of a tube 455 through a flow rate meter 456. To the other end of the tube 455, the main deaerator 511*a* is connected. One end of a tube 580 is connected with the main deaerator 511*a,* while the other end of the tube 580 is connected with one end of a tube 581 through a vacuum meter 521. To the other end of the tube 581, a vacuum pump 522 is connected.

To the main deaerator 511*a,* one end of a tube 571 is further connected, while the other end of the tube 571 is connected with a dissolved oxygen meter 520 which serves as a device to measure the deaeration level. The dissolved oxygen meter 520 is provided with a sensor 523 serving as measurement means, and a magnetic stirrer 524. To the upper end of the dissolved oxygen meter 520, one end of a tube 572 is connected, while the other end of the tube 572 is connected with one end of a tube 573 and one end of a tube 574 by means of a joint 577. To the other end of the tube 574, a three-way valve 504 is connected. Further, to the three-way valve 504, one end of a tube 553 as well as one end of a tube 575 are connected. The other end of the tube 553 is connected with a tube 551 through a coupler 555, and the other end of the tube 551 is connected with a connector 102. On the connector 102, an ink jet head 120*a* is installed.

On the other hand, a three-way valve 502 is connected with the other end of a tube 573 which is connected with the tubes 572 and 574 through the joint 577. To this three-way valve 502, the other end of the tube 452 described earlier, and one end of a tube 576 are further connected. To the other end of the tube 576, a three-way valve 505 is connected. To the three-way valve 505, the other end of the tube 575 and one end of a tube 554 are connected. To the other end of the tube 554, one end of a tube 552 is connected through a coupler 556, while the other end of the tube 552 is connected with the connector 102. Means for switching the supply paths is structured by the three-way valves 504 and 505.

When the tubes 551 and 552 are separated by means of couplers 555 and 556, the ink jet head 120*a* can be removed from the ink supply system. As the couplers 555 and 556, it is arranged to use those whose ends are not closed but are left in the released state when the tubes themselves are separated by means of the couplers 555 and 556. In this way, when the tubes themselves are connected by means of the couplers 555 and 556, the air that has flown into the interior of the couplers 555 and 556 becomes easier to escape. On the coupler 555, an attachment/detachment sensor 557 is installed. On the coupler 556, an attachment/detachment sensor 558 is installed. The attachment/detachment sensors 557 and 558 detect whether or not the couplers 555 and 556 themselves are connected. Hence, the color filter manufacturing apparatus is structured so as not to allow the ink supply system to be operated unless the tubes themselves are connected securely by means of the couplers 555 and 556.

Here, the ink supply route is formed by the ink route arranged to reach the ink jet head 120*a* from the tube 451 connected to the sub-tank 401*a,* through the main deaerator 511, the dissolved oxygen meter 520, and others. Also, by means of the tubes 452 and 453, the bypass path is formed to allow ink having passed the main deaerator 511*a* to flow into the sub-tank 401*a*. On the way of this bypass path, the end of the tube 356 serving as one end of the intertank supply pass described earlier is connected with a portion of the joint 471, while the tube 351 which is the other end of the intertank supply path is connected with the main tank 301*a*. Then, the portion of the ink supply route from the sub-tank 401*a* to the three-way valves 504 and 505, together with the tubes 452 and 453 that form the bypass path, constitutes the ink circulating path that enables ink having flown from the sub-tank 401*a* to the tube 451 to return to the sub-tank 401*a* again.

Of the tubes described above, all the tubes on the main tank 301 side of the deaerator 321 for the subservient use, and the tube 360 between the drain 404 of the sub-tank and the main tank 301 are the PN tube (Trade mark: manufactured by Nitta-Moor K.K.) formed by special polyolefin series resin. As to the size of the tubes, only the tube 360 has the outer diameter of ϕ12/inner diameter of ϕ8 (unit: mm, the same for those tubes to follow), while all the others, the outer diameter of ϕ6/inner diameter of ϕ4. Also, all the tubes that reside between the deaerator 321 and the ink jet head 120 are formed by PVDF (polyvinylidene fluoride). Only the tubes 551 and 552 that are connected with the ink jet head 120 has the outer diameter of ϕ4/inner diameter of ϕ2, and all the others, the outer diameter of ϕ6/inner diameter of ϕ4. In this respect, the pump (not shown) arranged inside the main pump 302 is a silicon tube.

Here, in accordance with the present embodiment, the tubes and each of the component parts are connected by means of stainless tube joints.

Now, the description will be made of the gas permeability of the PVDF (polyvinylidene fluoride) which is the material used for the tubes in accordance with the present embodiment.

At first, each permeability of the typical resin materials is shown in the Table 1 with respect to oxygen and nitrogen.

TABLE 1

| | Oxygen Permeability cc · mil/ 100 in 2 · 24 hr · atm | Nitrogen Permeability cc · mil/ 100 in 2 · 24hr. atm |
|---|---|---|
| PTFE | 1050 | 390 |
| PVDF | 3–4 | 1–2 |
| ETFE | 148 | 45 |
| PVF | 3.3 | 0.6 |
| FEP | 990 | 360 |
| PCTFE | 4–90 | 1.5–22 |
| ECTFE | 25 | 10 |
| High density polyethylene | 190 | 40 |
| Polypropylene | 240 | 50 |
| Soft polyvinyl chloride | 8–30 | 1–10 |
| Polyvinyl alcohol | 120 | — |
| Cellulose acetate | 120–150 | 30–40 |
| Polycarbonate | 300 | 50 |
| Polyvinylidene chloride | 2.4 | — |

Of those listed in this table, PVDF, PVF, and polyvinylidene chloride are the materials whose gas (oxygen and nitrogen) permeability is lower. However, of the three, PVF and polyvinylidene chloride are dissolved when heated, making it very difficult to form them as tubes using each of them as a single material, because the tube formation process is usually accompanied by heating. Therefore, it is only the PVDF that is formable as the tubes by itself, while having a lower gas permeability. The PVDF has also resistance to ink which is generally used including ink used for the present embodiment.

As a result, in accordance with the present invention, the PVDF tubes are adopted for the tubes used for the ink supply route from the deaerators to the ink jet heads. As the material for the PVDF tubes, KYNAR 2800 (available from ELF Atchem Japan, Inc.) is usable, for example. Here, it is also preferable to use the EXLON PVDF tubes (manufactured by Iwase K.K.).

Figure 3A:
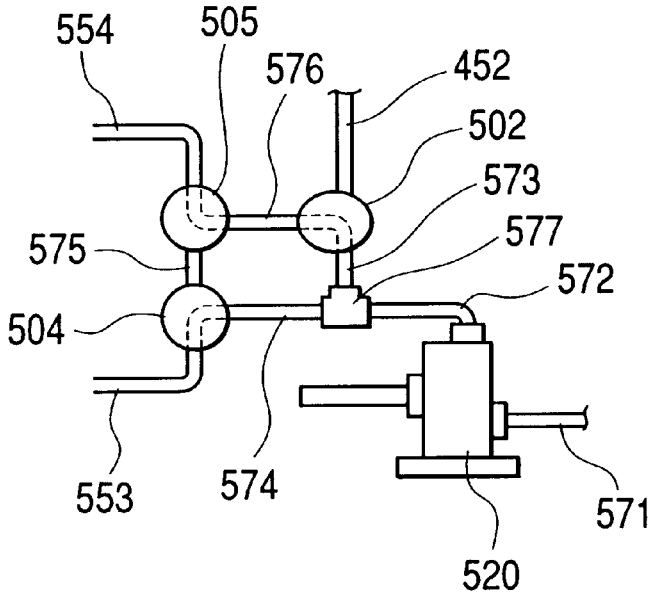
FIGS. 3A and 3B are views which illustrate the operation of the three-way valve of the ink supply system represented in FIG. 2.
Figure 3B:
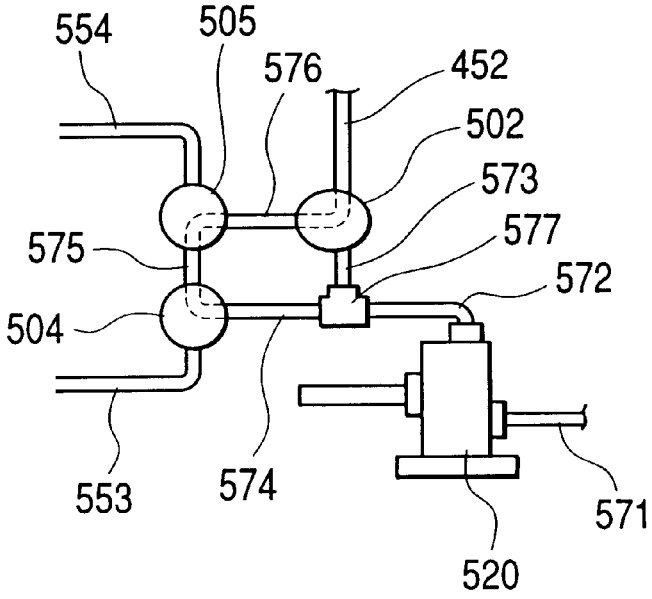

FIGS. 3A and 3B are views which illustrate the operation of the three-way valves 502, 504, and 505 of the ink supply system represented in FIG. 2. FIG. 3A shows the state of the three-way valves 502, 504, and 505 when ink is discharged from the ink jet head. FIG. 3B shows the state of the three-way valves when ink should be bypassed for filling the ink supply system with ink as described later or at the time of replacing ink.

As shown in FIG. 3A, when ink is discharged from the ink jet head 120*a,* the tubes 573 and 576 are communicated by means of the three-way valve 502, while the end of the tube 452 on the three-way 502 side is closed. On the three-way valve 505, the tubes 576 and 554 are communicated, while the end of the tube 575 on the three-way valve 504 side is closed. On the three-way valve 504, the tubes 574 and 553 are communicated, while the end of the tube 575 on the three-way valve go 504 side is closed. Therefore, when ink is discharged, ink which has been fed out by means of the turbine 402*a* from the sub-tank 401*a* to the dissolved oxygen meter 520 passes the dissolved oxygen meter 520 and the tube 572, and then, branched into the tubes 574 and 573 by means of the joint 577. The ink thus branched by the joint 577 is supplied to the ink jet head 120*a* through the respective supply paths.

As shown in FIG. 3B, when ink is bypassed, the tube 452 and the tube 576 are communicated by means of the three-way valve 502, and the end of the tube 573 on the three-way valve side is closed. On the three-way valve 505, the tube 576 and the tube 575 are communicated. Then, the end of the tube 554 on the three-way valve 505 side is closed. On the three-way valve 504, the tube 575 and the tube 574 are communicated. Then, the end of the tube 553 on the three-way valve 505 side is closed. Therefore, when ink is bypassed, ink fed out to the dissolved oxygen meter 520 is carried further to the tube 452 through the tube 572, joint 577, tube 574, three-way valve 504, tube 575, three-way valve 505, and tube 576, three-way valve 502 in that order after having passed the dissolved oxygen meter 520. In this case and when ink flows reversely, the ink, which flows in the tube 452 toward the three-way valve 502, is carried into the dissolved oxygen meter 520. With the three-way valves 502, 504, and 505 being in such state, the ink jet head 120*a* is not connected with the main tank 301*a* and the sub-tank 401*a* by way of the ink supply route.

The switching operation of the three-way valves 502, 504, and 505 shown in FIGS. 3A and 3B is controlled by use of the control box 27 shown in FIG. 1.

Now, the description will be made of the component parts arranged for the ink supply route of the ink supply system described above.

For the sub-tank 401*a,* there are provided the turbine 402*a* that pressurizes ink to be carried toward the flow rate meter 456 through the tube 451, and the motor 402 that drives the turbine 402*a.* By the motor 402 and the turbine 402*a,* pressure means is formed, which is controlled to be driven or stopped by means of the control box 27 shown in FIG. 1. On the side surface of the sub-tank 401*a,* the drain 404 is arranged at a predetermined height from the bottom surface of the sub-tank. To the drain 404, one end of the tube 358 is connected, while the other end of the tube 358 is led to the main tank 301*a.*

Also, for the sub-tank 401*a,* the sub-tank remainders sensor 405 is provided to detect the ink remainders in the sub-tank 401*a* so that the liquid level of ink is not lowered equal to or less than a specific height in the sub-tank 401*a.* With this arrangement, it becomes possible to prevent the air from being compressed into the ink supply route when ink is pressurized and fed out from the sub-tank 401*a* by means of the turbine 402*a,* thus lowering the liquid level in the sub-tank 401*a* and make it empty eventually. In accordance with the present embodiment, the structure is arranged so that the sub-tank remainders sensor 405 is actuated when the height of ink is reduced to the liquid level which is set to be lower by 10 mm than the height of ink in the sub-tank 401*a* at which ink is allowed to flow out to the main tank 301*a* through the drain 404. When the sub-tank remainders sensor 405 detects such liquid level, ink is refilled from the main tank 301*a* to the sub-tank 401*a* by driving the main pump 302. In this case, the main pump 302 is driven until ink flows out from the drain 404.

The flow rate meter 456 is to measure the flow rate of ink fed under pressure from the sub-tank 401*a.* As the flow rate meter 456, a meter is used so that both the instantaneous flow rate and accumulated flow rate can be measured.

The main deaerator 511*a* is the same as the deaerator 321, which removes the dissolved gas in ink. In the interior of the main deaerator 511*a,* a bundle of several gas permeable hollow pieces is arranged. When ink passes the hollow pieces thus bundled, the dissolved gas in ink is removed by the evacuating suction given by the vacuum pump 522 from the outside of the hollow pieces. As the hollow deaeration film that forms the hollow pieces, resin fluoride (ethylene tetrafluoride) is used in the main deaeration 511*a.* Also, ink is deaerated with the vacuum of approximately 10 Torr provided by the vacuum pump 522.

Figure 4:
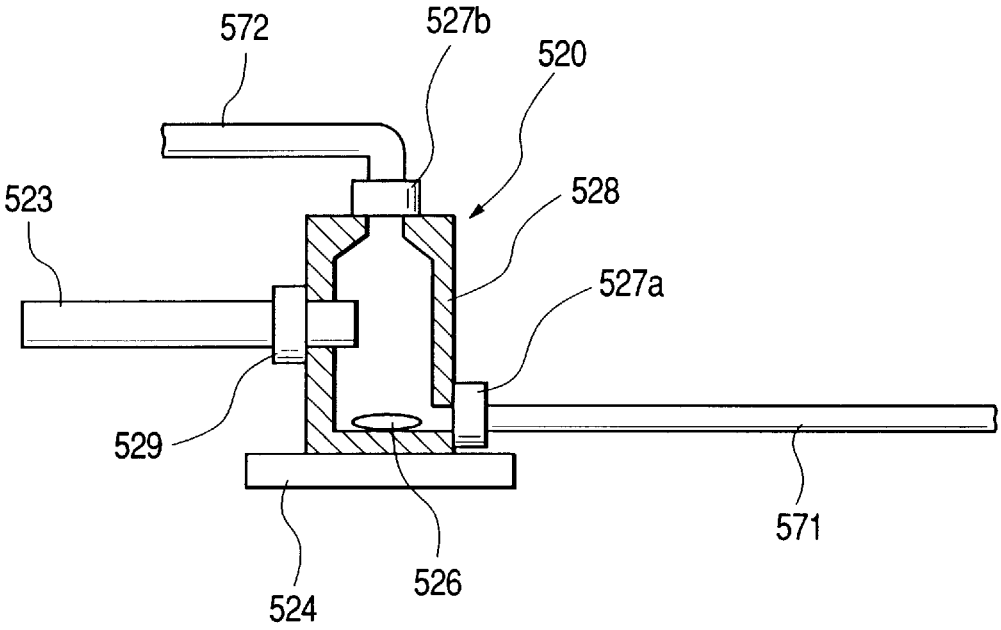
FIG. 4 is a cross-sectional view which shows the details of a dissolved oxygen meter represented in FIG. 2.

The dissolved oxygen meter 520 is to measure the deaeration level of ink after having passed the main deaerator 511*a.* FIG. 4 is a cross-sectional view which shows the details of the dissolved oxygen meter 520. As shown in FIG. 4, for the dissolved oxygen meter 520, a tube 571 is connected by use of a tube joint 527*a* to the lower side surface of the container 528 formed by resin (PVDF, for instance) having a lower gas permeability or stainless steel. To the upper surface of the container 528, a tube 572 is connected by use of a tube joint 527*b.* Then, in a position different from the one for the tube 571 on the side surface of the container 528, a sensor 523 is fixed by use of a sensor fixing jig 529 in such manner that no ink leakage is caused from the interior of the container at all. The sensor 523 is installed to be substantially horizontal. As the inner configuration of the container 528, it is arranged to taper the upper part thereof to make it easier for the air in the container 528 to escape to the tube 572 together with ink. In this way, even if the air enters the interior of the container 528, ink, which is pressurized and fed from the sub-tank 401*a,* may flow into the container 528 from the bottom thereof through the tube 571. Then, together with the ink thus flowing in, the air in the container 528 may easily flow into the tube 572 from the upper part of the container 528.

The sensor 523 uses the polraro type oxygen electrode. By the measurement principle of the sensor 523, oxygen is dissipated at the leading end of the electrode unit of the sensor 523 arranged in the container 528. Therefore, in order to measure the exact deaeration level, it is necessary to agitate liquid in the vicinity of the leading end of the sensor 523 because of such measurement principle of the dissolve oxygen meter, which will be described later.

Also, during the discharges of ink from the ink jet head 120*a,* the consumption of ink is extremely small. Hence, there is almost no flow of ink in the container 528. Therefore, in order to agitate ink in the container 528, a rotator 526 having magnets in it is provided in the container 528. Also, on the bottom surface of the container 528, a magnetic stirrer 524 is installed to enable the rotator 526 to rotate. By means of the magnetic stirrer 524, the rotator 526 rotates in the state of being in contact with the bottom surface of the container 528. In this manner, ink in the container 528 is always agitated for making the exact measurement possible with respect to the amount of dissolved oxygen in ink.

The Measurement Principle of the Dissolved Oxygen meter

The polaro type dissolved oxygen meter used as the dissolved oxygen meter 520 shown in FIG. 2 and FIG. 4 is generally called the diaphragm type dissolve oxygen electrode. This meter uses deoxidation as the measurement principle thereof.

Figure 5:
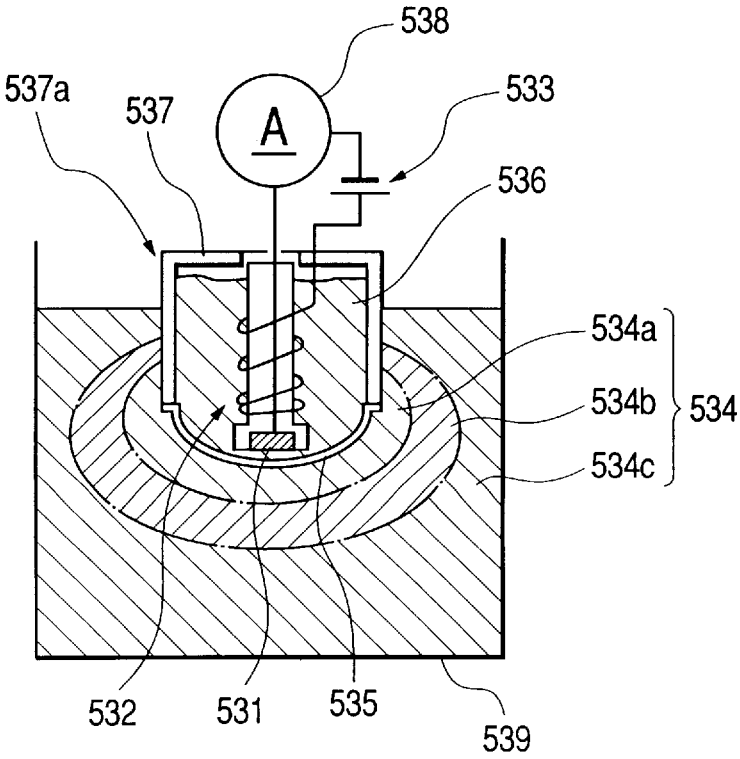
FIG. 5 is a view which schematically illustrates the measurement principle of the polraro type dissolved oxygen meter

FIG. 5 is a view which schematically illustrates the measurement principle of the polaro type dissolved oxygen meter. As shown in FIG. 5, the polaro type dissolved oxygen meter is structured by an oxygen electrode 537*a,* a low-voltage electric-supply source 533, and a direct current ammeter 538. In the oxygen electrode 537*a,* one end of the electrode body 537 is open. Such aperture of the electrode body 537 is covered by a diaphragm 534 to close the one end of the electrode body 537. In the interior of the electrode body 537, the silver rod-like anode 532 is arranged. On the end portion of the anode 532 on the diaphragm 535 side, the platinum cathode 531 is arranged. Also, in the electrode body 537, electrolytic solution 536 is filled. In the electrolytic solution 536, the cathode 531 and the anode 532 are immersed. The oxygen electrode 537*a* thus formed is immersed in the measurement solution 534 in the container 539 with the diaphragm 535 being directed downward. The cathode 531 and the anode 532 are electrically connected with the specific voltage supply source 533 and the DC ammeter 538 outside the container 539.

A dissolved oxygen meter of the kind, a specific voltage (600 to 700 mA, for instance) required for reducing oxygen is applied in advance between the cathode 531 and the anode 532 by use of the low-voltage supply source 533. When oxygen in a measuring liquid 534 permeates the diaphragm 535 to be dissolved in the electrolytic solution 536, the dissolved oxygen is reduced to hydrogen radical by the cathode 531, thus reduced current runs in the circuit of the dissolved oxygen meter. The chemical reaction of the anode 532 at this juncture is expressed in the formula (1) given below, and the chemical reaction of the cathode 531 is expressed in the formula (2) given below.

$$4Ag+4OH^- \rightarrow 2Ag_2O+2H_2O \quad (1)$$

$$O_2+2H_2O+4e \rightarrow 4OH^- \quad (2)$$

As expressed by the above formula (2), the reduced current is proportional to the oxygen concentration in the measuring liquid 534. For example, if oxygen in the measuring liquid 534 increases, the amount of oxygen to be dissolved into the electrolytic solution 536 becomes larger after being permeated through the diaphragm 535. Then, the reduced current that flows in the DC ammeter 538 becomes larger in proportion to the oxygen concentration in the electrolytic solution 536. Also, in the liquid 534 during measurement, the region nearer to the diaphragm 535 presents a low concentration region 534*a* where the oxygen concentration is lower, and the outer side of the low concentration region 534*a* becomes the intermediate concentration region 534*b* where the oxygen concentration is higher than that of the low concentration region 534*a.* Then, the outer side of the intermediate concentration region 534*b* becomes the high concentration region 534*c* where the oxygen concentration is higher than that of the intermediate concentration region 534*b.* In this way, the dissolved oxygen meter measures the reduced current that runs in the circuit of the dissolved oxygen meter, and converts the measured value of the reduced current into the oxygen concentration for the measurement thereof in the liquid 534 to be measured.

As described above, the polaro type oxygen electrode performs the specific potential electrolysis of oxygen by means of the external electrode using platinum as the cathode, silver as the anode, and alkaline solution as the electrolytic solution. Against the polaro type oxygen electrode, there is another measurement method adopted for the diaphragm type dissolved oxygen meter, that is, the galvanic type. In this type, platinum is used as the anode, lead is used as the cathode, and alkaline solution is used as the electrolytic solution, but not using the external electrode. Then, by the utilization of the voltage generated by the cell reaction of the oxygen electrode itself, the specific potential electrolysis of oxygen is performed.

As compared with the galvanic type, the polaro type has more advantages as given below. The first advantage is a better reproducing capability of measurement. The second one is the less amount of sediment to be generated, thus stabilizing the measurement for a long time. The third one is the smaller influence exerted by the temperature, because voltage is applied to the oxygen electrode. With these advantage in view, the present embodiment adopts the polaro type dissolved oxygen meter for use.

Now, the description will be made of the installation of the sensor 523, which is almost perpendicular to the container 528 as shown in FIG. 4. If the dissolved oxygen meter shown in FIG. 5 is used for a long time, the layer of silver chloride is formed on the surface of the anode 532, and then, the layer of silver chloride is peeled off from the anode 532 to enter and reside between the cathode 531 and the diaphragm 535. If silver chloride resides between the cathode 531 and the diaphragm 535, it becomes impossible to obtain the stable performance of the dissolved oxygen meter eventually. Therefore, if the method having the oxygen electrode 537*a* with the diaphragm 535 should be installed downwardly, it is made easier for silver chloride to enter and reside between the cathode 531 and the diaphragm 535. This method is not desirable when the meter is used for a long time. Also, on the contrary, if the oxygen electrode 537*a* is installed with the diaphragm 535 upwardly, the sensor 523 should be installed on the bottom surface of the container 528 of the dissolved oxygen meter shown in FIG. 4. However, on the bottom surface of the container 528, the rotator 525 is installed to make agitation. As a result, on the bottom surface of the container 528, both the sensor 523 and magnetic stirrer 524 for use of the rotator should be arranged side by side. This inevitably requires a large container to make such arrangement possible. If the container 528 should become larger, the amount of ink that resides in the container 528 also becomes larger. This is not desirable. Therefore, the sensor 523 is installed almost horizontally to the container 528 in order to make the life of the sensor 523 longer, while making the inner volume of the container 528 as small as possible for the dissolved oxygen meter shown in FIG. 4.

The Operation of the Ink Supply System

Now, with reference to FIG. 2 and FIGS. 3A and 3B, the description will be made of the operation of the ink supply system shown in FIG. 2. When ink is discharged by the ink jet head 120*a,* the three-way valves 502, 504, and 505 are controlled so as to be in the state shown in FIG. 3A. Usually, when ink is discharged by each ink jet head, ink in the sub-tank 401*a* is fed out by the negative pressure exerted following ink discharges, and ink is caused to flow to the joint 577 through the tube 451, flow rate meter 456, tube 455, main deaerator 511*a*, tube 571, dissolved oxygen meter 520, and tube 572 in that order. Ink is then branched into the tubes 573 and 574 by means of this joint 577. Ink that flows into the tube 574 is supplied to the ink jet head 120*a* through the three-way valve 504, tube 553, coupler 555, tube 551, and connector 102 in that order. On the other hand, ink that flows into the tube 573 by means of the joint 577 is supplied to the ink jet head 120*a* through the three-way valve 502, tube 576, three-way valve 505, tube 554, coupler 556, tube 552, and connector 102 in that order.

When ink is supplied as described above, it is discharged from the discharge ports of the ink jet head 120*a* to the transparent glass substrate for coloring. Then, per coloring on one substrate or several substrates, motor 402 is driven to rotate the turbine. Thus, ink in the sub-tank 401*a* is fed under pressure to perform the pressure recovery to feed it to the ink jet head 120*a*. In this case, ink to be fed to the ink jet head 120*a* passes the deaerator 321 and the main deaerator 511*a*. As a result, the bubbles in ink that may cause instable discharges are not contained in ink, but also, the dissolved gas in ink is almost removed. Here, the deaeration level of ink is always monitored by the dissolved oxygen meter 520, and the pressure recovery is performed so that the amount of dissolved oxygen in ink is kept lower than the predetermined value. In this way, it becomes possible to materialize the stable performance of ink jet heads.

Also, to materialize the stabilized discharges, the three-way valves 502, 504, and 505 are switched to the bypass condition as shown in FIG. 3B when the ink supply system is not in operation for a long time or some other case where the amount of dissolved oxygen should exceed the predetermined value. Also, the two-way valve 403 is kept in the state of being opened. Then, the motor 402 is driven to rotate the turbine 402*a* so as to enable ink in the sub-tank 401*a* is pushed out to the tube 451 and pass the main deaerator 511*a*. After that, the three-way valves 502, 504, and 505 are switched to the condition of ink discharges as shown in FIG. 3A. Then, the motor 402 is again driven to supply ink through main deaerator 511*a* to the ink jet head 120*a* after it has been deaerated sufficiently. Here, it becomes unnecessary to dissipate ink wastefully, while ink whose amount of dissolved oxygen is kept less than the predetermined value. In this manner, ink is supplied to the ink jet heads for the implementation of the stabilized ink discharges.

The Operation of Ink Filling

Now, the description will be made of the operation when ink is filled in the ink supply system shown in FIG. 2.

At first, the two-way valves 304 and 403 are closed when ink is filled in the ink supply system, while the three-way valves 502, 504, and 505 are switched to be in the bypass condition. In this state, as the first process, the main pump 302 is driven to pump up ink in the main tank 301*a* through the tubes 351 and 352. Then, ink is filled almost in the entire ink supply route by passing the tube 353, filter 311, tubes 354 and 355, deaerator 321, tubes 356 and 452, three-way valve 502, tube 576, three-way valve 505, tube 575, three-way valve 504, tubes 574 and 572, dissolved oxygen meter 520, tube 571, main deaerator 511*a*, tube 455, flow rate meter 456, tube 451, sub-tank 401*a*, drain 404, and tube 358 in that order. In this case, the flow rate of the main pump 302 is set at 200 ml/min. Also, the vacuum pump 322 for use of the deaerator 321 is driven so that the vacuum in the deaerator 321 becomes approximately 30 Torr. Then, the vacuum pump 522 for use of the main deaerator 511*a* is driven so that the vacuum in the main deaerator 511*a* becomes approximately 10 Torr.

Immediately after the ink supply system is filled with ink by the first process described above, ink that has passed the deaerator 321 is distributed to all of the tubes 356 and 452, three-way valve 502, tube 576, three-way valve 505, tube 575, three-way valve 504, tubes 574 and 572, dissolved oxygen meter 520, tube 571, and main deaerator 511*a*. Ink that has passed the main deaerator 511*a* is further deaerated. Then, the tube 455, flow rate meter 456, tube 451, and sub-tank 401*a* are filled with the ink thus deaerated, respectively.

Now, however, as shown in FIG. 4, the interior of the container 528 that forms the dissolved oxygen meter 520 should provide a certain volume as a space for the provision of the leading end of the sensor 523, as well as a space needed for enabling the rotator 526 to rotate. Therefore, the inner volume of the container 528 is made approximately 10 ml. Also, with a view to making it easier for the air, which has been carried into the interior of the container 528 through the tube 571, to escape outside the container 528 through the tube 572, it is arranged for container 528 to set the tubes 571 and 572 accordingly. Here, the tube 571 is connected to the lower part of the container 528 as described earlier, while the tube 572 is connected with the upper part of the container 528. Therefore, when ink is filled as described above, not all the air that has entered the interior of the container 525 from the tube 572 escapes through the tube 571. Thus, the air remains partly in the interior of the container 528.

In this respect, therefore, after the main pump 302 is driven for a specific period of time to fill ink in the ink supply system, the main pump 302 is stopped, and then, only the two-way valve 403 is left in the state of being open. Subsequently, as the second process, the motor 402 is driven to carry ink in the direction opposite to the ink flow in which ink has been filled as described earlier. In this case, since the main pump 302 is structured to cut off the ink flow in the tubes connected with the main pump 302 when the operation of the main pump 302 is at rest, ink which is carried from the sub-tank 401*a* is not allowed by means of the joint 471 to flow in the direction toward the tube 356, but ink is caused to return to the sub-tank 401*a* through the tubes 453 and 454.

By the second process, the air is removed almost completely from the ink route between the main deaerator 511*a* and the sub-tank 401*a* by way of the dissolved oxygen meter 520, three-way valves 504, 505, and 502. Also, ink thus deaerated is circulated to the interior of the sub-tank 401*a* or further to the main deaerator 511*a* by passing the main deaerator 511*a* and the tree-way valves 504, 505, and 502 by way of the tubes 452 and 453, two-way valve 403, and tube 454. In this manner, the interior of the ink route is all filled with the deaerated ink with the exception of the tube 573. By repeating the first and second processes of the circulating operation for several times, the circulating ink passes the main deaerator 511*a* several times, thus enabling the deaeration level of ink to be increased. Here, the operations of the first and second processes described above are controlled by means of the control box 27 shown in FIG. 1.

Then, in order to fill the deaerated ink in the remaining portions which have not been filled with it as yet, the three-way valves 502, 504, and 505 are switched to the condition of ink discharges as shown in FIG. 3A. After that, the motor 402 is driven to feed ink from the sub-tank 401*a* so as to fill the tubes 573, 553, 554, 551, and 552 with the deaerated ink.

As described above, for the convention ink jet recording apparatus, the ink route is provided in the vicinity of the ink jet head 1100 to enable ink to be circulated by way of such path with the exception of the ink jet head 1100. Then, only with the installation of a deaerator on such ink route, a considerable amount of the ink that may reside on the path between the deaerator and the ink jet head 1100 should be wastefully discarded. However, with the ink supply system of the present invention, it becomes possible to fill the entire system with the deaerated ink efficiently, while minimizing the wasteful consumption of ink.

The Operation of the Ink Replacement

Now, with reference to FIG. 2, and FIGS. 3A and 3B, the description will be made of the operation of ink replacement in the ink supply system represented in FIG. 2.

When ink should be replaced within the ink supply route, it is possible to implement such replacement without disconnecting the connector 102.

At first, the description will be made of the operation of drawing out ink from the ink supply system. The two-way valve 304 is open, while the two-way valve 403 is closed. The three-way valves 502, 504, and 505 are switched to the bypass condition as shown in FIG. 3B. In this state, the main pump 302 is driven. Then, the air is sucked in from the opening of the two-way valve 304 where nothing is connected. The air thus sucked in from the two-way valve 304 is caused to flow in the interior of the sub-tank 401*a* after having passed the tubes 357 and 352, main pump 302, tube 353, filter 311, tubes 354 and 355, deaerator 321, tubes 356 and 452, three-way valve 502, tube 576, three-way valve 505, tube 575, three-way valve 504, tubes 574 and 572, dissolved oxygen meter 520, tube 571, main deaerator 511*a,* tube 455, flow rate meter 456, and tube 451 in that order.

With the air that flows in this way, ink residing in the ink route is caused to flow into the interior of the sub-tank 401*a.* In the sub-tank 401*a,* the liquid level of ink is raised by ink that flows in from the tube 451. Then, ink in the sub-tank 401*a* is caused to flow into the main tank 301 through the drain 404 and the tube 358. Therefore, with the exception of ink that resides in the portion of the sub-tank 401*a* which is positioned lower than the drain 404, most of ink in the ink route is caused to flow into the main tank 301*a* eventually. In this manner, most of ink remaining in the ink route is collected into the main tank 301*a.*

Here, in order to collect ink remaining in the sub-tank 401*a,* the coupler socket 375 is connected with the coupler plug 374. After that, the suction pump 377 is driven to enable ink in the sub-tank 401*a* to be flown into the waste ink tank 379 after having passed the tube 451, flow rate meter 456, tube 455, main deaerator 511*a,* tube 571, dissolved oxygen meter 520, tubes 572 and 574, three-way valve 504, tube 575, three-way valve 505, tube 576, three-way valve 502, tubes 452 and 356, deaerator 321, tubes 355 and 373, coupler plug 374, coupler socket 375, tube 376, suction pump 377, and tube 378 in that order.

With the operation described above, ink becomes in the state of being substantially drawn out completely from the entire ink route with the exception of the main tank 301*a,* and the tubes 553, 554, 551, and 552 residing between the three-way valves 504 and 505, and the ink jet head 120*a,* and the tube 573. Then, after this, the main tank 301*a* is replaced with another main tank as a whole or ink in the main tank 301*a* is replaced, hence completing the ink replacement.

Further, after that, when the ink route of the ink supply system should be filled with the replaced new ink, the ink filling operation is carried out as described earlier. When such ink filling is operated, ink before replacement still remains as it is in the tube 573, and tubes 553, 554, 551, and 552, as well as in the ink jet head 120*a.* However, the remaining ink has already been deaerated, and the ink route that has been filled with ink before replacement has no room for the air to enter. For example, however, if the air has entered the tube 573, it is possible to remove the air in the tube 573 as described hereunder.

The two-way valve 304 is closed, while the two-way valve 403 is open. The three-way valves 502, 504 and 505 are switched to the condition of ink discharges. Then, the motor 402 is driven for a short period of time to press ink in the sub-tank 401*a* to flow into the tube 451, thus carrying the air in the tube 573 to the interior of the tube 576. Then, the three-way valves 502, 504, and 505 are switched to the bypass condition, and the motor 402 is driven. Thus, the air in the tube 576 is carried into the interior of the sub-tank 401*a* through the three-way valve 502, and tubes 452, 453, and 454. In this manner, the air no longer exists at all in the entire ink route of the ink supply system. Also, at this juncture, the ink before replacement, which still remains in the tube 573, is mixed with the newly replaced ink eventually. The ink remainders in the tube 573 is extremely small as compared with the entire amount of ink in the ink supply system. Also, its color is not entirely different, either, but the density and color are slightly different from each other. The level of difference is not such as to create any particular problem that may be caused by this mixture when color filters are manufactured.

After that, the three-way valves 502, 504, and 505 are switched to the state of ink discharges, and the motor 402 is driven. Thus, the ink before replacement, which still remains in the interior of the tubes 553, 554, 551, and 552, as well as in the ink jet head 120*a,* is pushed out from the discharge ports of the ink jet head 120*a.* Then, no air resides in the ink supply route at all. Not only the air is carried over into the ink jet head 120*a,* but also, the highly deaerated ink is carried into the ink jet head 120*a.*

Also, when ink is replaced, there is no need for removing the corresponding ink jet head. As a result, there is no need, either, for executing the positioning operation of such ink jet head immediately after it has been installed.

The Method for Manufacturing Color Filters

Now, with reference to FIGS. 6A to 6F, the description will be made of a method for manufacturing color filters by use of the color filter manufacturing apparatus of the present embodiment represented in FIG. 1.

FIGS. 6A to 6F are views which illustrate the method for manufacturing color filters using the color filter manufacturing apparatus represented in FIG. 1. In accordance with the method for manufacturing color filters by use of the color filter manufacturing apparatus of the present embodiment, a color filter is manufactured with the steps each shown in FIGS. 6A to 6F, respectively. Here, the reference mark hγ in FIG. 6C and FIG. 6E indicates each intensity of the irradiated light.

Figure 6A:
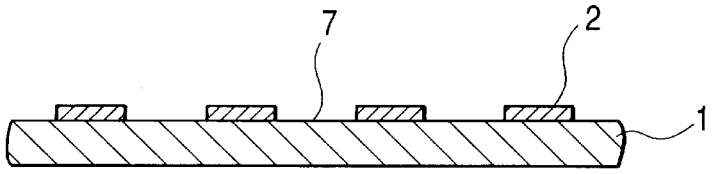
FIGS. 6A, 6B, 6C, 6D, 6E and 6F are views which illustrate a method for manufacturing color filters using the color filter manufacturing apparatus represented in FIG. 1.

At first, in FIG. 6A, on the surface of the substrate 1, the black matrix 2 is formed as the light shielded portion. The black matrix 2 has openings formed on the matrix, which serve as the light transmission section 7 on the surface of the substrate 1.

In accordance with the present embodiment, the glass substrate is generally used as the substrate 1. However, the substrate is not necessarily limited to the glass substrate if only it should be provided with the required property of a crystal liquid color filter, such as transparency, mechanical strength, among some others.

Figure 6B:
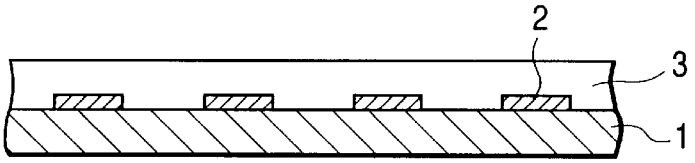

Now, as shown in FIG. 6B, on the surface of the substrate 1 having the black matrix 2 formed on it, coating is made with the resin component provided with ink acceptance, which is hardened by the irradiation of light or by heating combined with light irradiation, and then, prebaked, if necessary, so that the resin component layer 3 is formed. As the method for coating the resin component on the surface of the substrate 1, it is possible to use spin coating, roller coating, bar coating, spray coating, dip coating, or the like. However, the coating method is not necessarily limited to the one mentioned above.

Figure 6C:
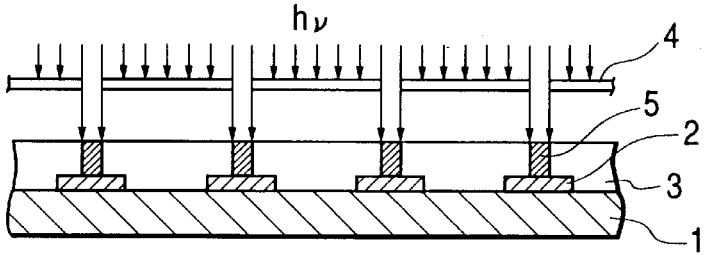

Then, as shown in FIG. 6C, on the surface of the resin component layer 3, the patterning exposure is performed by use of the photomask 4 which is provided with a desired pattern. Thus, the portion of the resin component layer 3 that corresponds to the black matrix 2 is partly hardened to form the non-colored portion 5 which does not absorb ink. Each non-colored portion 5 is formed to divide a plurality of openings formed on the black matrix 2 per opening. After that, the photomask 4 is removed.

Figure 6D:
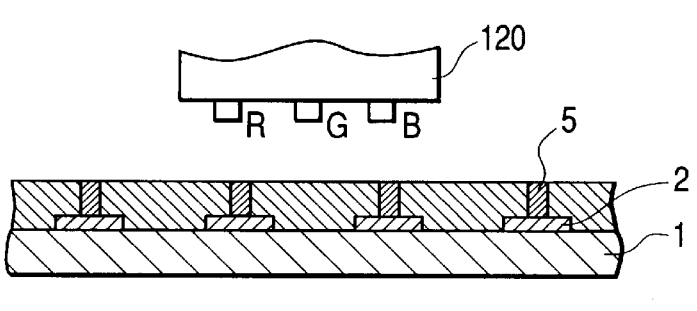

Then, as shown in FIG. 6D, coloring is performed for the resin component layer 3 by use of the ink jet heads 120 of the color filter manufacturing apparatus shown in FIG. 1. In this case, R ink is discharged from the corresponding ink jet head 120 on the R (red) region on the resin component layer 3. Likewise, G ink is discharge from the corresponding ink jet head 120 on the G (green) region, and B ink on the B (blue) region. Coloring of the resin component layer 3 is performed by the ink jet heads 120 at a time in one step of process. Then, if necessary, ink on the substrate 1 is dried. As shown in FIG. 6C, the photomask 4 used in this respect is provided with openings for use of hardening each portion of the resin component layer 3 that corresponds to the black matrix 2 as described earlier. At this juncture, in order to avoid any missing of the application of colorant on the portion which is in contact with the black matrix 2, it is necessary to apply ink in a comparatively larger quantity. In this respect, it is preferable to make each opening of the photomask 4 narrower than that of the black matrix 2 as shown in FIG. 6C.

As the ink used for coloring, it is possible to adopt either of the colorant ink or pigment ink, and also, to use liquid ink or solid ink equally.

As the ink jet method usable for the present embodiment, it is possible to use a bubble jet type that uses electrothermal transducing elements as the energy generating element or a piezo jet type that uses piezoelectric elements. It is also possible to set the coloring area and the coloring pattern arbitrarily.

Also, in accordance with the present embodiment, the example in which black matrix is formed on a substrate is shown, but there is no particular problem even if the black matrix is formed after the formation of the resin component layer that can be hardened or formed on the resin component layer after the execution of coloring. The formation mode of the black matrix is not necessarily limited to the one described in accordance with the present embodiment. Also, as the method for forming the black matrix, it is preferable to form a thin metallic film on the substrate by means of sputtering or deposition and to pattern the metallic thin film in the photolithographic process. However, the formation thereof is not necessarily limited to this method.

Figure 6E:
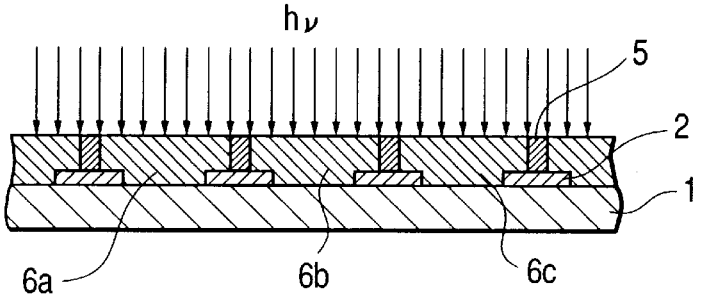

Now, as shown in FIG. 6E, the resin component layer 3 is hardened only by the light irradiation or only by the heat treatment or by the combination thereof. Then, on the surface of the substrate 1, the red region 6*a,* green region 6*b,* and blue region 6*c* are formed.

Figure 6F:
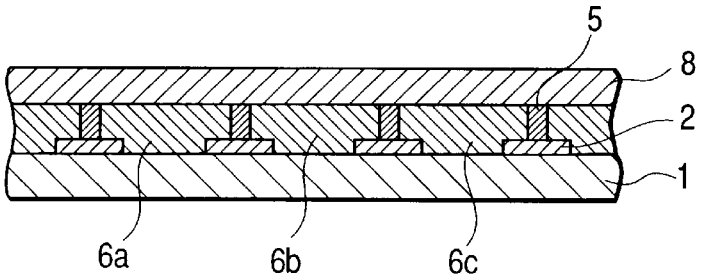

Subsequently, as shown in FIG. 6F, a protection layer 8 is formed, if necessary, on the entire surface of the red region 6*a,* green region 6*b,* blue region 6*c,* and non-coloring portion 5. Here, in FIG. 6C and FIG. 6E, the light intensity is indicated by the reference mark hγ, but in the case of the heat treatment, heat is given instead of the light whose intensity is indicated by hγ. Also, the protection layer 8 is formed by the resin component of a type which can be hardened by the light irradiation, the heat application or the combination thereof, or formed by sputtering or deposition of inorganic material. However, it should be good enough if only the layer material has transparency usable as a color filter, and at the same time, it can withstand sufficiently the formation process of ITO (indium tin oxide) and the formation process of the orientated film, among some other processes.

The Structure of Color filters

Figure 7:
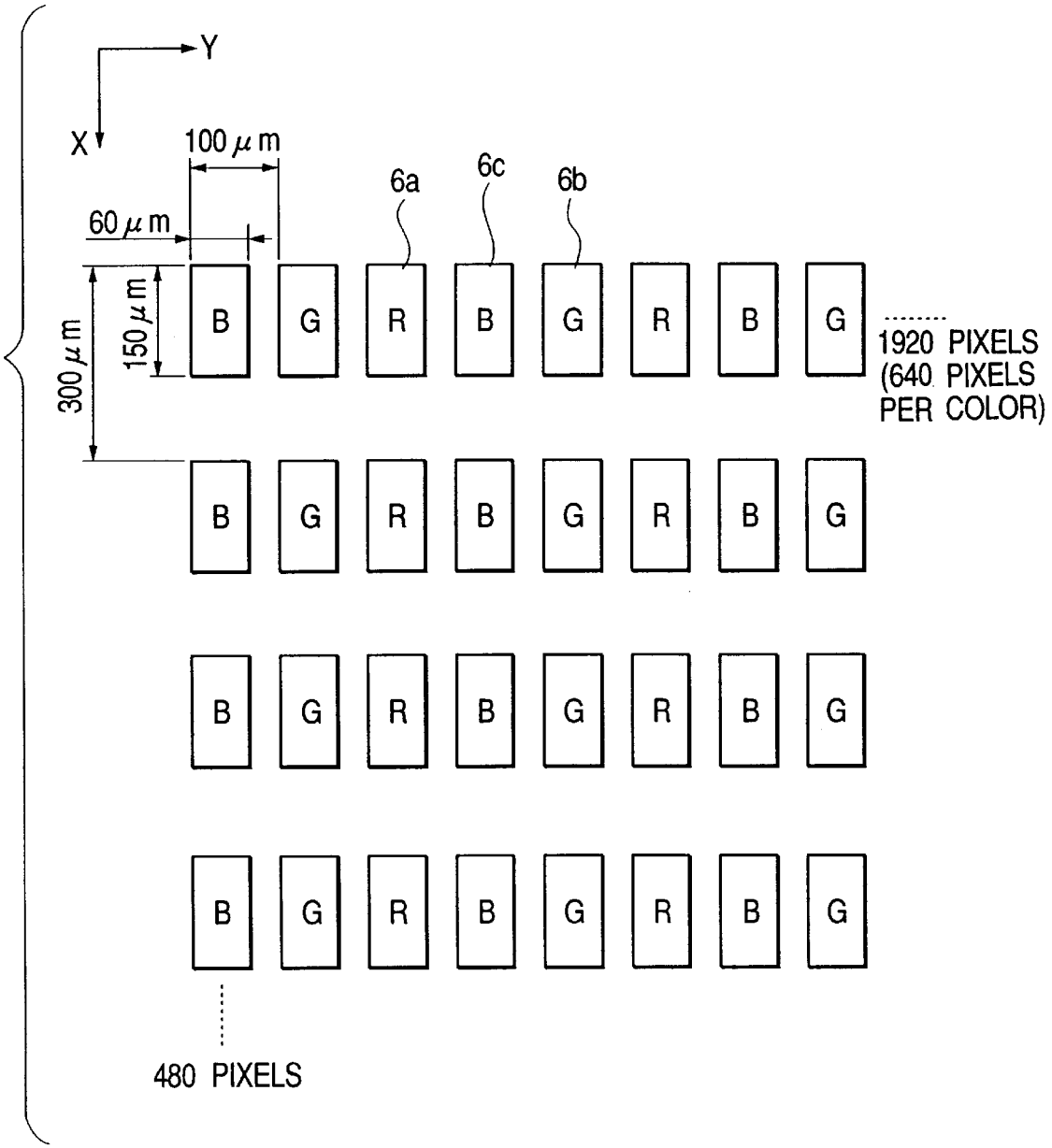
FIG. 7 is a view which shows the pattern of a color filter manufactured by the color filter manufacturing apparatus represented in FIG. 1.

Now, the description will be made of a color filter manufactured by the method for manufacturing color filters described above. FIG. 7 is a view which shows the pattern of a color filter manufactured by the color filter manufacturing apparatus of the present embodiment.

As shown in FIG. 7, each of the red region 6*a,* green region 6*b,* and blue region 6*c* colored by R (red), G (green), and B (blue) ink forms one pixel (a filter element). The shape of each pixel is almost rectangular. The size of pixel is 150 μm×60 μm, equally for all the pixels. It is assumed that the longitudinal direction of one pixel is in the direction X and the direction at right angles to the direction X is the direction Y. Pitches in the direction X is 300 μm, and the pitches in the direction Y is 100 μm. Then, the pixels of the same color is arranged on straight line in the direction X, while the three pixels of R, G, B being arranged in that order are arranged repeatedly in the direction Y. Also, the color filter pattern shown in FIG. 7 corresponds to the pattern of the black matrix 2 formed in the process represented in FIG. 6A. The numbers of pixels are 480 in the direction X, and 1,920 (640 per color) in the direction Y.

Figure 8:
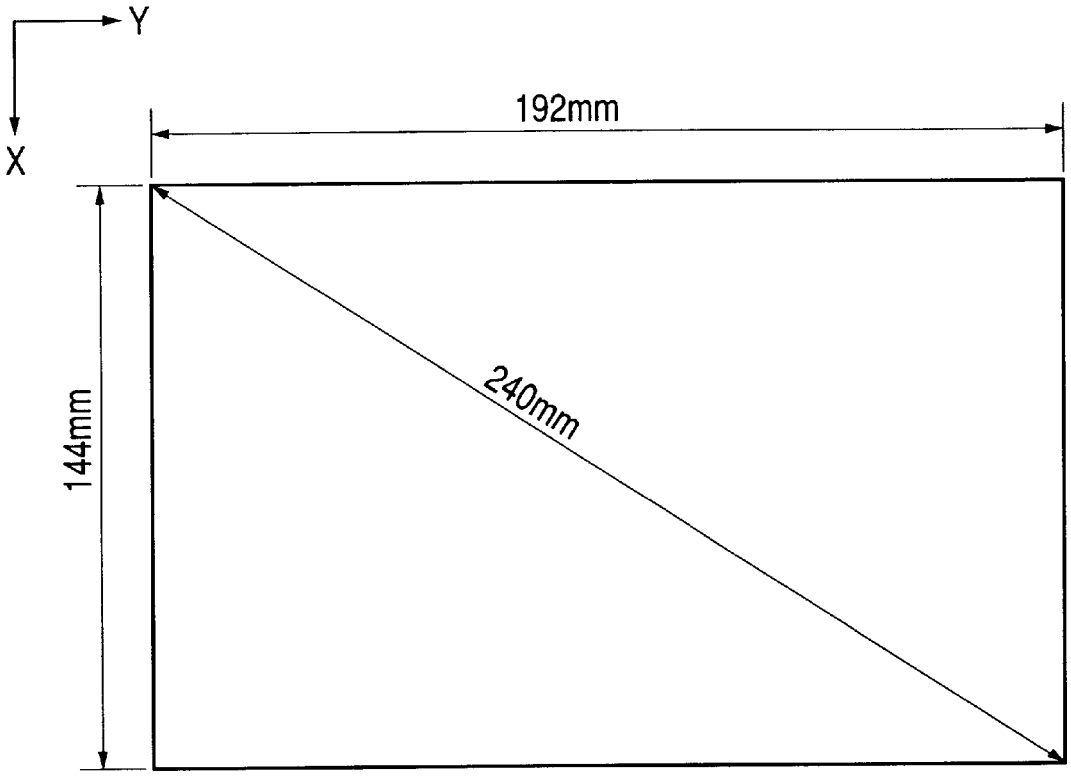
FIG. 8 is a view which shows the entire screen of a color filter manufactured by the color filter manufacturing apparatus represented in FIG. 1.

FIG. 8 is a view which shows the size of the entire screen of the color filter manufactured by the color filter manufacturing apparatus of the present embodiment represented in FIG. 1. As shown in FIG. 8, the size of the entire screen of the color filter is 144 mm×192 mm, with the length of the diagonal line thereof is 240 mm, which corresponds to a liquid crystal panel of 9.4 inch-size.

Second Embodiment

As compared with the first embodiment, the color filter manufacturing apparatus of a second embodiment is different in a part of ink supply system that forms the color filter manufacturing apparatus. What differs from the first embodiment is the means for switching the supply paths that constitutes the ink supply system. All the other structures are the same as those of the first embodiment. Hereinafter, the description will be made of such aspect that differs from the first embodiment.

Figure 9A:
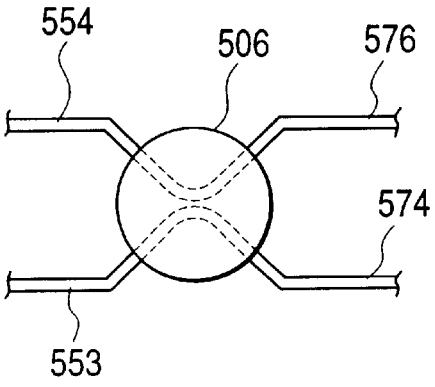
FIGS. 9A and 9B are partially enlarged views which illustrate the characteristics of the color filter manufacturing apparatus in accordance with a second embodiment of the present invention.
Figure 9B:
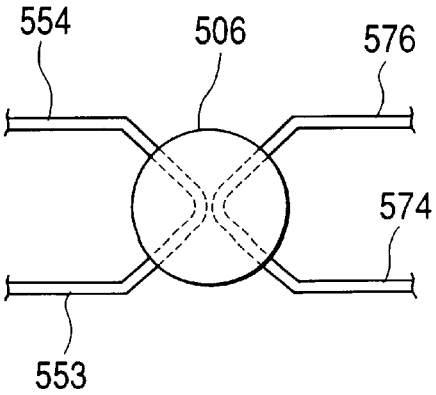

FIGS. 9A and 9B are views that illustrate the special features of the color filter manufacturing apparatus in accordance with the present embodiment, which are enlarged views of the switching means of the supply paths of the ink supply system. Also, each condition of the switching means of the supply paths is shown in FIGS. 9A and 9B, respectively.

For the color filter manufacturing apparatus of the present embodiment, the three-way valves 504 and 505 of the first embodiment represented in FIG. 2 are replaced by a four-way valve as shown in FIGS. 9A and 9B. In other words, the switching means of the supply paths is formed by the four-way valve 506. To this four-way valve 506, each end of tubes 553, 554, 574, and 576 is connected, respectively.

FIG. 9A shows that the four-way valve 506 is in the ink discharge condition. When ink is discharged, the tubes 576 and 552 are communicated by means of the four-way valve 506, and likewise, the tubes 574 and 553 are communicated simultaneously.

FIG. 9B shows that the four-way valve 506 is in the ink bypass condition. When ink is bypassed, the tubes 576 and 574, and the tubes 554 and 553 are communicated by means of the four-way valve at the same time.

As described above, the means for switching supply paths of the ink supply system is structured by the four-way valve 506 for the color filter manufacturing apparatus of the present embodiment. In this manner, it is possible to carry out the same operation exactly as in the ink supply system in accordance with the first embodiment.

Third Embodiment

As compared with the first embodiment, a color filter manufacturing apparatus in accordance with a third embodiment of the present invention is different in a part of the ink supply system that forms the color filter manufacturing apparatus. The ink supply system of the present embodiment is structured without the three-way valves 504 and 505 provided for the ink supply system of the first embodiment represented in FIG. 2. All the other structures are the same as the first embodiment. Hereinafter, therefore, the description will be made of the aspect that differs from the first embodiment.

Figure 10:
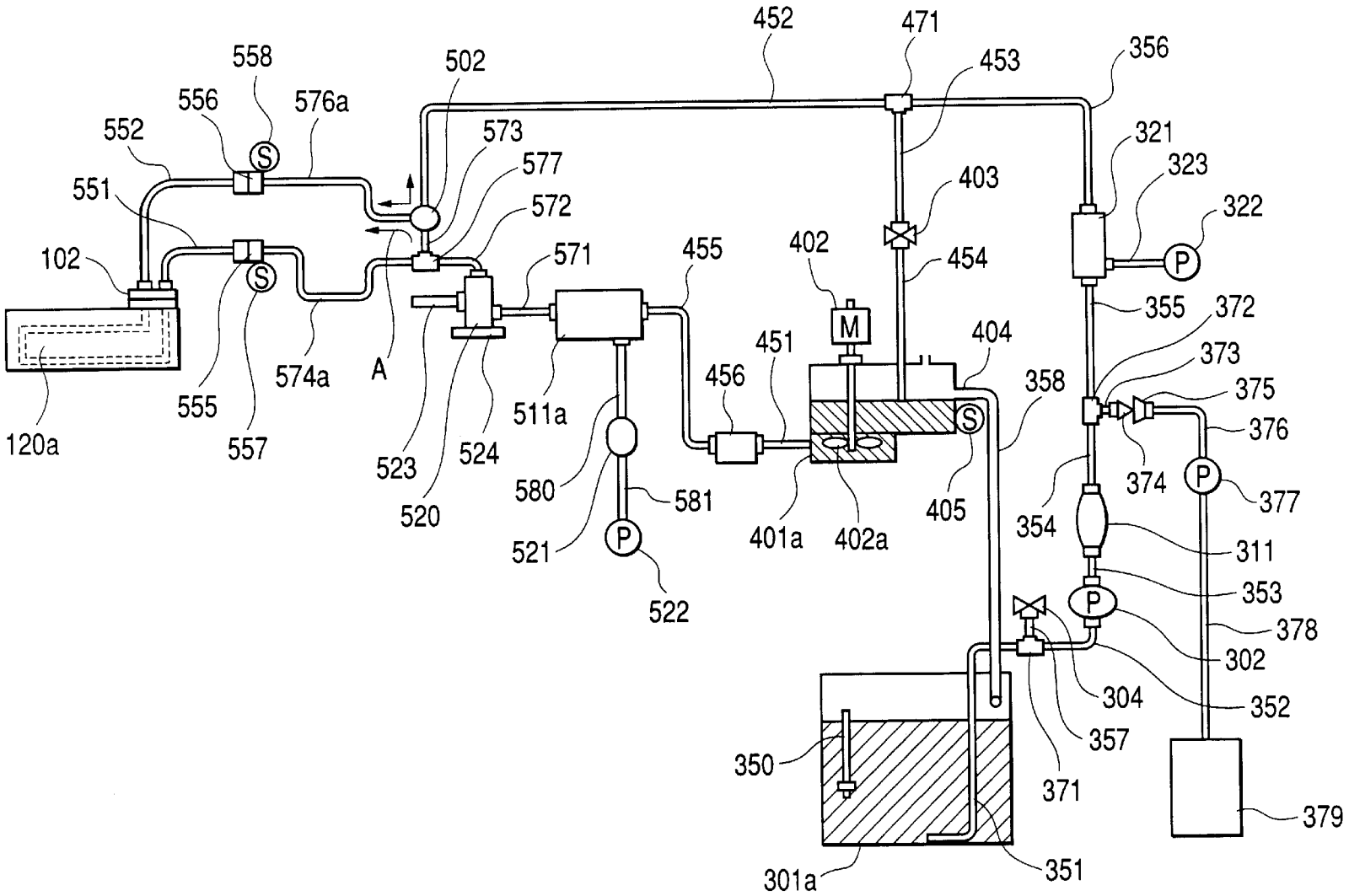
FIG. 10 is a view which schematically shows the structure of the ink supply system of a color filter manufacturing apparatus in accordance with a third embodiment of the present invention.
Figure 11:
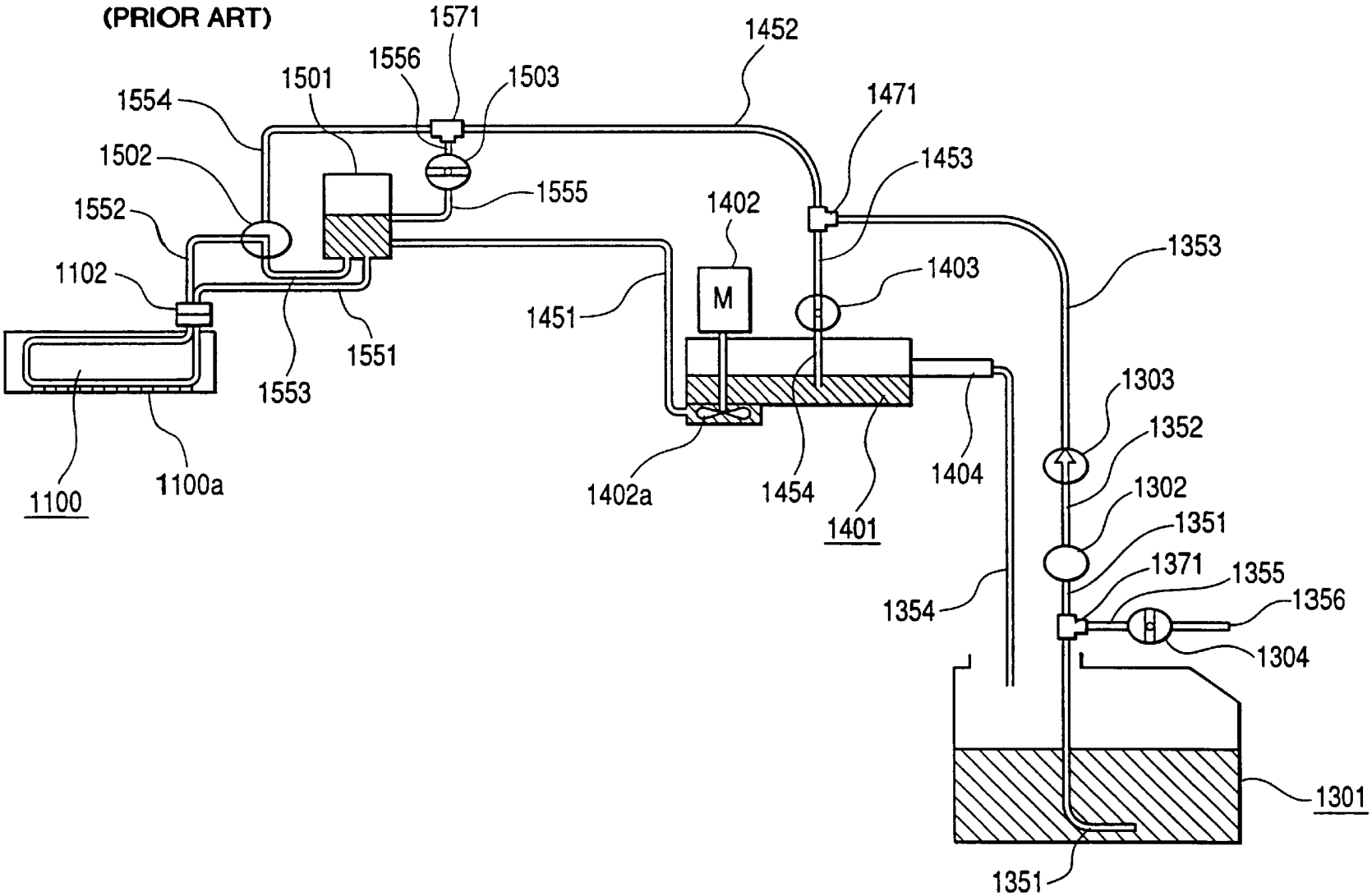
FIG. 11 (PRIOR ART)
FIG. 11 is a view which schematically shows the structure of the ink supply system of an ink jet recording apparatus in accordance with the conventional art.
Figure 12:
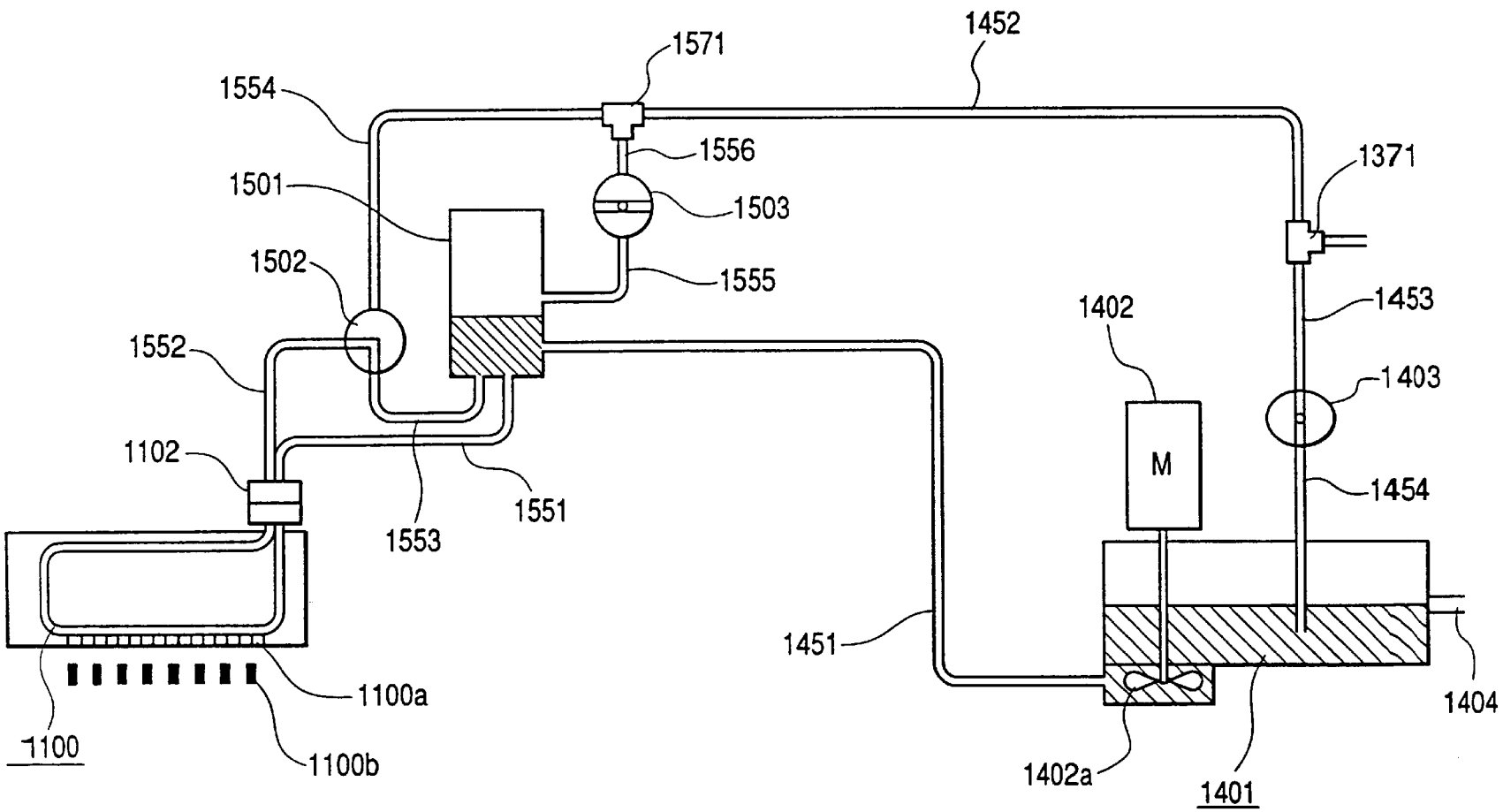
FIG. 12 (PRIOR ART)
FIG. 12 is a partially enlarged view which shows the ink supply system represented in FIG. 11.

FIG. 10 is a view which schematically shows the structure of the ink supply system of the color filter manufacturing apparatus in accordance with the present embodiment. In FIG. 10, the same reference marks are applied to the same constituents as those of the first embodiment.

For the ink supply system of the color filter manufacturing apparatus of the present embodiment, the three-way valve 502 and the coupler 556 are connected by means of the tube 576*a,* and also, the ends of the tubes 572 and 573 are connected with one end of the tube 574*a* by means of the joint 577 as shown in FIG. 10. Here, at the same time, the other end of the tube 574*a* is connected with the coupler 555. Also, the interior of the ink jet head 120*a* is structured to enable ink to be circulated.

Usually, when the ink jet head 120*a* discharges ink, the three-way valve 502 is in the ink discharge condition as described above. Then, ink in the sub-tank 401*a* is carried to flow into the main deaerator 511*a* through the tube 451. The ink, which has passed the main deaerator 511*a* to enable it to be deaerated to a specific level, is branched by means of the joint 577 in the direction toward the tube 574*a* or toward the tube 573 after having passed the dissolved oxygen meter 520. The ink that has been branched into the two directions passes the ink supply route, respectively. In this manner, the ink that has been deaerated to the specific level by the main deaerator 511*a* is supplied to the ink jet head 120*a.*

Also, if the amount of dissolved oxygen in ink in the ink supply route is increased when the color filter La manufacturing apparatus is left intact for a long period of time, or due to some other reasons, the motor 402 is driven to press ink in the sub-tank 401*a* to flow into the tube 451. Then, ink passes the main deaerator 511*a* to enable it to be deaerated to a higher level. The highly deaerated ink is then supplied to the ink jet head 120*a.* In this case, the ink, which resides in the ink supply route between the main deaerator 511*a* and the ink jet head 120*a,* is exhausted from the discharge ports of the ink jet head 120*a.* Here, the ink whose dissolved oxygen content has exceeded the predetermined level in the ink supply route is consumed wastefully. However, as in the case of the first and second embodiments, it is possible to supply the ink jet head 120*a* with the ink that has been deaerated to a high level within the specific value. As a result, the stabilized ink discharge is implemented by use of a simpler structure than that of the first and second embodiment, hence making it possible to obtain a color filter manufacturing apparatus capable of providing a high production yield at lower costs.

Now, the color filter manufacturing apparatus of the present invention has been described in accordance with the first to third embodiments, but an ink jet recording apparatus which is provided with the ink supply system shown for the first to third embodiments can also demonstrate the same effects as described above. In other words, the bubbles that may invite the disabled discharge or the instability of discharges can be prevented from being carried into the ink jet head. Further, it is possible to obtain an ink jet recording apparatus capable of filling its ink supply system with ink having a specific deaeration level in a shorter period of time without wasting ink. With the ink jet recording apparatus thus arranged, it is possible to exhaust the air mixed in ink outside the ink route without consuming ink wastefully even if the air is mixed in ink. Moreover, it is possible to obtain an ink jet recording apparatus capable of recording images in high precision, while reducing the frequency of maintenance required for the ink supply system thereof.

In accordance with the present invention that has been described above, the ink jet recording apparatus provided with the deaerator in its ink supply route is further provided with the ink circulating path that enables ink to the tank after having passed the deaerator. As a result, even when ink in the ink supply route contains dissolved gas more than a predetermined level, such ink is returned to the tank by way of the ink circulating path. Therefore, it becomes possible to prevent bubbles and dissolved gas in ink that may invite the disabled discharge or the instability of discharges from being carried into the ink jet head, hence obtaining a highly reliable ink jet recording apparatus.

Also, when the ink jet recording apparatus described above is used for a color filter manufacturing apparatus, it becomes possible to obtain the color filter manufacturing apparatus capable of producing color filters in high production yield at lower costs, because the ink that has been deaerated to the specific level is reliably supplied to the ink jet head of the ink jet recording apparatus adopted for the color filter manufacturing apparatus.

Further, for the ink jet head provided with the main tank, sub-tank, and deaerator, there are provided an ink circulating path, and the intertank supply path the one end of which is connected with the midway of the bypass that forms the ink circulating path, and the other end of which is connected with the main tank. Here, there is an effect that when ink in the ink jet recording apparatus should be replaced with different ink, the interior of the ink route can be filled with ink that has been deaerated to the specific level so as not to allow the air to be mixed in the ink route. Further, in this case, ink can be replaced in a shorter period of time without removing the ink jet head, hence avoiding the wasteful consumption of ink. As a result, there is an effect that this arrangement leads to the provision of an ink jet recording apparatus for which the frequency of the required maintenance can be reduced. Moreover, there is an effect that when the air is mixed in the ink route, it is possible to exhaust the air outside the ink route without consuming ink wastefully.

Further, when the ink jet recording apparatus described above is adopted for use of a color filter manufacturing apparatus, it becomes possible to obtain the color filter manufacturing apparatus capable of reducing the frequency of the maintenance required therefor, at the same time, presenting a higher productivity in the manufacture of color filters.

As described above, in accordance with the present invention, it is possible to supply the ink jet head efficiently with the deaerated ink running immediately after the deaerator even if the ink supply route is long from the deaerator to the ink jet head, hence obtaining stabilized ink discharges from the ink jet head. Also, it is possible to suppress the mixture of the air in ink in the ink supply route so as to minimize the reduction of the deaeration level of the deaerated ink, that is, to suppress the fluctuation of the deaeration level thereof. Then, in accordance with the present invention, color filters can be manufactured stably in good quality without unevenness.

Also, PVDF (polyvinylidene fluoride) resin has excellent resistance to many kinds of inorganic acid, and part of alkali straight-chain hydrocarbon, aliphatic, aromatic hydrocarbon, organic acid, alcohol, or the like. This resin dually has resistance to ink for use of color filters, which is formed by solvent of water and normal hydrocarbon or aromatic hydrocarbon, among some others. Therefore, tubes are not eroded by ink, and there is no possibility that unwanted components are dissolved into ink, which may produce unfavorable effect on ink discharges of the ink jet head.

What is claimed is:

1. An ink jet recording apparatus for recording by discharging ink, said apparatus comprising:

an ink tank for retaining ink to be discharged;

an ink jet head provided with discharge ports for discharging ink from said ink tank;

an ink route connecting said ink tank with said ink jet head to enable the ink to flow from said ink tank to said ink jet head; and a deaerator arranged along said ink route to remove gas dissolved in the ink within said ink route, wherein at least a section connecting said deaerator and said ink jet head in said ink route is formed of a material that includes a polyvinylidene fluoride resin material.

2. An ink jet recording apparatus according to claim 1, further comprising:

a second ink route connecting said ink jet head with said ink tank, wherein deaerated ink passing said ink jet head is returned to said ink tank through said second ink route.

3. An ink jet recording apparatus according to claim 1, further comprising a second ink tank, and a second ink route connecting said ink jet head with said second ink tank, wherein deaerated ink passing said ink jet head is returned to said second ink tank through said second ink route.

4. An ink jet recording apparatus according to claim 1, further comprising a deaeration level measurement device for measuring a deaeration level, said deaeration level measurement device being arranged in the section connecting said deaerator with said ink jet head.

5. An ink jet recording apparatus according to claim 4, wherein said deaeration level measurement device comprises a container having a resistance to gas permeability and a measurement unit in the container, the container including a connecting portion on an upper part thereof on a side of said ink route connected with said ink jet head and a connecting portion on a lower part thereof on a side of said ink route connected with said deaerator.

6. An ink jet recording apparatus according to claim 5, wherein said measurement unit is a dissolved oxygen meter.

7. An ink jet recording apparatus according to claim 6, wherein the dissolved oxygen meter is of a polaro type.

8. An ink jet recording apparatus according to claim 7, wherein the dissolved oxygen meter includes a portion in a form of a rod and is installed on a side wall of the container substantially horizontally.

9. A color filter manufacturing apparatus comprising:

an ink jet recording apparatus according to claim 1; and a substrate used in forming a color filter, wherein the ink jet head of said ink jet recording apparatus and said substrate for forming the color filter are shifted relative to one another, and a color filter is manufactured by discharging ink from the ink jet head.

10. An ink jet recording apparatus for recording by discharging ink, said apparatus comprising:

first and second ink tanks for retaining ink to be discharged;

an ink jet head provided with a plurality of discharge ports for discharging ink retained in the first and second ink tanks;

a first ink route connecting said first ink tank with one end of said ink jet head;

a second ink route connecting said second ink tank with the other end of said ink jet head;

a third ink route being connected with a first connecting portion along said first ink route and being connected with a second connection portion along said second ink route; and first and second switch units for changing ink flow paths provided for the first connection portion and the second connection portion, respectively.

11. An ink jet recording apparatus according to claim 10, wherein said first and second switch units are three-way valves.

12. An ink jet recording apparatus according to claim 10, further comprising a deaerator arranged in said first ink route.

13. An ink jet recording apparatus according to claim 12, wherein said deaerator in said first ink route is arranged between said first ink tank and the first connecting portion.

14. An ink jet recording apparatus according to claim 13, further comprising a deaeration level measurement device arranged between said deaerator and the first connecting portion for measuring a deaeration level of ink flowing in said first ink route.

15. An ink jet recording apparatus according to claim 14, wherein said deaeration level measurement device is a dissolved oxygen meter.

16. An ink jet recording apparatus according to claim 14, further comprising:

a controller for controlling an ink supply and stop thereof in accordance with the deaeration level measured by said deaeration level measurement device.

17. An ink jet recording apparatus according to claim 16, wherein said controller controls a switching operation of said first and second switch units in accordance with the deaeration level measured by said deaeration level measurement device.

18. An ink jet recording apparatus according to claim 12, wherein at least a connecting path portion between said deaerator and said ink jet head is structured by a tube formed of a material that includes polyvinylidene fluoride resin.

19. An ink jet recording apparatus according to claim 10, said first and second ink supply routes are structured with tubes formed of a material that includes polyvinylidene fluoride resin.

20. A color filter manufacturing apparatus comprising:

an ink jet recording apparatus according to claim 12; and a substrate used in forming a color filter, wherein the ink jet head of said ink jet recording apparatus and said substrate for forming the color filter are shifted relative to one another, and a color filter is manufactured by discharging ink from the ink jet head.

21. An ink jet recording apparatus for recording by discharging ink, said apparatus comprising:

an ink tank for retaining ink to be discharged;

an ink jet head provided with a plurality of discharge ports for discharging ink retained by said ink tank;

a first ink route connecting said ink tank with one end of said ink jet head;

a second ink route connecting a second ink tank with the other end of said ink jet head;

a third ink route connected with a first connecting portion along said first ink route and connected with a second connection portion along said second ink route; and first and second switch units for changing ink flow paths provided for the first connection portion and the second connection portion, respectively.

22. An ink jet recording apparatus according to claim 21, wherein said first and second switch units are three-way valves.

23. An ink jet recording apparatus according to claim 21, further comprising a deaerator arranged in said first ink route.

24. An ink jet recording apparatus according to claim 23, wherein said deaerator in said first ink route is arranged between said ink tank and the first connecting portion.

25. An ink jet recording apparatus according to claim 24, further comprising a deaeration level measurement device arranged between said deaerator and the first connecting portion for measuring a deaeration level of ink flowing in said first ink route.

26. An ink jet recording apparatus according to claim 25, wherein said deaeration level measurement device is a dissolved oxygen meter.

27. An ink jet recording apparatus according to claim 25, further comprising:

a controller for controlling an ink supply and stop thereof in accordance with the deaeration level measured by said deaeration level measurement device.

28. An ink jet recording apparatus according to claim 27, wherein said controller controls a switching operation of said first and second switch units in accordance with the deaeration level measured by said deaeration level measurement device.

29. An ink jet recording apparatus according to claim 23, wherein at least a connecting path portion between said deaerator and said ink jet head is structured by a tube formed of a material that includes polyvinylidene fluoride resin.

30. An ink jet recording apparatus according to claim 21, said first and second ink supply routes are structured with a tube formed of a material that includes polyvinylidene fluoride resin.

31. A color filter manufacturing apparatus comprising:

an ink jet recording apparatus according to claim 21; and a substrate used in forming a color filter, wherein the ink jet head of said ink jet recording apparatus and said substrate for forming the color filter are shifted relative to one another, and a color filter is manufactured by discharging ink from the ink jet head.

* * * * *

UNITED STATES PATENT AND TRADEMARK OFFICE

CERTIFICATE OF CORRECTION

PATENT NO. : 6,224,201 B1
DATED : May 1, 2001
INVENTOR(S) : Yoshihiro Shigemura

It is certified that error appears in the above-identified patent and that said Letters Patent is hereby corrected as shown below:

Column 1,
Line 36, "such" should read -- such a --.

Column 2,
Line 5, "rain" should read -- resin --.

Column 4,
Line 58, "elements" should read -- element --; and
Line 65, "such" should read -- such a --.

Column 5,
Line 36, "apparats." should read -- apparatus. --.

Column 6,
Line 20, "current" should read -- currently --; and
Line 66, "apparats." should read -- apparatus. --.

Column 7,
Line 59, "head" should read -- heads --; and
Line 61, "of" should read -- of the --.

Column 8,
Line 1, "deaerator" should read -- deaerators --;
Line 11, "rubbed" should read -- rubbed against --;
Line 15, "supply" should read -- the supply of --;
Line 34, "used" should read -- uses --;
Line 48, "in" should read -- in a --;
Line 65, "head;" should read -- head; and --.

Column 9,
Line 21, "accordance" should read -- accordance with --;
Line 45, "polraro" should read -- polaro --; and
Line 47, "of" should read -- of a --.

Column 11,
Line 63, "heads" should read -- head --.

Column 12,
Line 67, "polraro" should read -- polaro --.

UNITED STATES PATENT AND TRADEMARK OFFICE

CERTIFICATE OF CORRECTION

PATENT NO. : 6,224,201 B1
DATED : May 1, 2001
INVENTOR(S) : Yoshihiro Shigemura

It is certified that error appears in the above-identified patent and that said Letters Patent is hereby corrected as shown below:

Column 13,
Line 67, "one" should read -- ones --.

Column 17,
Line 17, "go" should be deleted.

Column 18,
Line 40, "such" should read -- such a --;
Line 52, "polraro" should read -- polaro --; and
Line 58, "dissolve" should read -- dissolved --.

Column 19,
Line 9, "dissolve" should read -- dissolved --.

Column 25,
Line 20, "discharge" should read -- discharged --.

Column 27,
Line 50, "La" should be deleted; and
Line 67, "embodiment," should read -- embodiments, --.

Column 30,
Line 57, "claim 10," should read -- claim 10, wherein --; and
Line 62, "claim 12;" should read -- claim 10; --.

Column 32,
Line 18, "claim 21," should read -- claim 21, wherein --.

Signed and Sealed this

Ninth Day of July, 2002

*Attest:*

*Attesting Officer*

JAMES E. ROGAN
*Director of the United States Patent and Trademark Office*